US011702998B2

(12) United States Patent
Dudar et al.

(10) Patent No.: US 11,702,998 B2
(45) Date of Patent: Jul. 18, 2023

(54) METHODS AND SYSTEMS FOR REDUCING HYDROCARBON BREAKTHROUGH

(71) Applicant: Ford Global Technologies, LLC, Dearborn, MI (US)

(72) Inventors: Aed Dudar, Canton, MI (US); Kenneth Pifher, Taylor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/456,711

(22) Filed: Nov. 29, 2021

(65) Prior Publication Data

US 2023/0167777 A1 Jun. 1, 2023

(51) Int. Cl.

*F02D 15/00* (2006.01)
*F02D 41/00* (2006.01)
*F02D 41/14* (2006.01)

(52) U.S. Cl.

CPC ..... *F02D 15/00* (2013.01); *F02D 41/004* (2013.01); *F02D 41/008* (2013.01); *F02D 41/1498* (2013.01); *F02D 2200/0602* (2013.01); *F02D 2200/0606* (2013.01); *F02D 2200/703* (2013.01)

(58) Field of Classification Search

CPC ..... F02D 15/00; F02D 41/004; F02D 41/008; F02D 41/1498; F02D 2200/0602; F02D 2200/0606; F02D 2200/703

See application file for complete search history.

(56) References Cited

U.S. PATENT DOCUMENTS

| | | | | |
|---|---|---|---|---|
| 9,677,512 | B2 | 6/2017 | Dudar et al. | |
| 9,850,832 | B2 | 12/2017 | Dudar | |
| 10,273,927 | B2 | 4/2019 | Glugla | |
| 10,794,312 | B2 | 10/2020 | Dudar | |
| 10,968,847 | B2 * | 4/2021 | Ikeda | F01N 3/101 |
| 2007/0233360 | A1 * | 10/2007 | Hill | F02D 19/0623 701/123 |
| 2015/0369148 | A1 * | 12/2015 | Mano | F02M 25/0854 123/521 |

FOREIGN PATENT DOCUMENTS

WO WO-2014125849 A1 * 8/2014 ..... F02D 15/02

OTHER PUBLICATIONS

Torchinsky, J., "The World's-First Variable Compression Ratio Engine Could Kill Diesel Forever," Jalopnik Website, Available Online at https://jalopnik.com/worlds-first-variable-compression-ratio-engine-could-ki-1785295848, Aug. 15, 2016, 6 pages.

Dudar, A., "Systems and Methods for Reducing HC Breakthrough," U.S. Appl. No. 17/451,271, filed Oct. 18, 2021, 51 pages.

* cited by examiner

*Primary Examiner* — Joseph J Dallo

(74) *Attorney, Agent, or Firm* — Vincent Mastrogiacomo; McCoy Russell LLP

(57) ABSTRACT

Methods and systems are provided for controlling a vehicle engine to reduce engine knock and increase fuel efficiency by reducing hydrocarbon breakthrough. In one example, a method may include adjusting a compression ratio of a variable compression engine in response to hydrocarbon breakthrough above a threshold from a fuel vapor canister of an evaporative emissions system.

18 Claims, 8 Drawing Sheets

METHODS AND SYSTEMS FOR REDUCING HYDROCARBON BREAKTHROUGH

FIELD

The present description relates generally to methods and systems for controlling a vehicle engine to reduce engine knock and increase fuel efficiency.

BACKGROUND/SUMMARY

As emissions standards become increasingly strict, manufacturers are looking for ways to decrease emissions while maintain or increasing vehicle power output. One such approach in gasoline engines may include variable compression ratio engines (VCE). A VCE may adjust the mechanical compression ratio of the engine by actuating a harmonic drive mechanism that increases the stroke travel of the piston. Therein, a compression ratio may be adjusted to increase fuel efficiency while maintaining or increasing torque. An increased compression ratio may result in more heat generated in a combustion cylinder, resulting in fuel auto-ignition.

Further, vehicle evaporative emissions control (EVAP) systems may be configured with at least one fuel vapor canister to capture non-combusted fuel vapors, such as hydrocarbon (HC) vapors, which may otherwise be released to atmosphere as undesirable evaporative emissions. Vapors trapped by the canister may be purged to the engine intake manifold for combustion. However, due to incomplete purging and other conditions including ambient air temperature and vehicle temperature, some HC vapor may bleed to the atmosphere. When a VCE is operating at a high compression ratio, breakthrough HC vapor into engine cylinders may cause pre-ignition of fuel and/or engine knock, which may result in degraded combustion.

Attempts to address engine knock in VCE include adjusting ignition timing based on an estimated biasing force. One example approach is shown by Glugla et al. in U.S. Pat. No. 10,273,927. Therein, a pressure-reactive piston is disposed within a combustion chamber of an internal combustion engine and ignition timing is adjusted responsive to an estimated biasing force of the pressure-reactive piston, for example, a force of gas contained within a base against a top wall of the pressure-reactive piston. Another example approach is shown by Dudar in U.S. Pat. No. 9,850,832. Therein, a method may be employed for reducing bleed-through emissions (e.g., of HC vapors) by implementing canister purge operations during engine-off conditions. However, the inventors herein have recognized potential issues with such systems. As one example, compression of fuel and vapors may result in premature ignition and, while spark timing may be advanced or delayed to compensate for premature ignition, the method described by Glugla is based on determining an engine knock amount. Ideally, engine knock is mitigated, as knock may degrade elements of the engine. Additionally, implementing canister purge operations during engine-off conditions, as described by Dudar, may not address HC vapor bleedthrough during a power demand from a vehicle operator and/or engine-on conditions.

In one example, the issues described above may be addressed by a method for a variable compression engine, comprising adjusting a compression ratio of the variable compression engine in response to hydrocarbon breakthrough above a threshold from a fuel vapor canister of an evaporative emissions system. In this way, reducing hydrocarbon breakthrough may reduce a likelihood of engine knock and improve fuel efficiency.

As one example, hydrocarbon breakthrough may be determined by at least one of a temperature sensor, pressure sensor, or hydrocarbon sensor. Upon detection of hydrocarbon breakthrough above the threshold, the compression ratio of the variable compression engine may be decreased and combustion ignition mode of the variable compression engine may be changed from compression ignition to spark ignition. Switching to spark ignition at a lower compression ratio may decrease hydrocarbon breakthrough. When hydrocarbon breakthrough is below the threshold, for example, when a rate of fuel vaporization is less than a rate of fuel desorption from the fuel vapor canister, the compression ratio may be increased to the starting compression ratio and the combustion ignition mode may be switched from spark ignition to compression ignition. Adjusting the compression ratio in response to hydrocarbon breakthrough during engine operation may result in engine knock being reduced based on a rate of vaporization rather than based on engine knock. A duration of engine operation wherein engine knock occurs may thus be reduced. Additionally, implementing the method during engine operation may result in reduced interruption to vehicle operation, for example, due to engine hesitation during engine operating mode shifts.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 3A-3B are shown approximately to scale.

DETAILED DESCRIPTION

The following description relates to systems and methods for inferring a high rate of fuel vaporization and performing mitigating steps to prevent increased evaporative emissions. In one example, inference of the high rate of vaporization may be performed by at least one of a fuel tank pressure sensor (e.g., fuel tank pressure transducer, FTPT), a hydrocarbon (HC) sensor, and a thermocouple positioned at the outlet of a fuel vapor canister. Mitigating steps may include transitioning an operating mode (e.g., a combustion ignition mode and a compression ratio) of a variable compression engine (VCE) from a fuel efficiency mode (e.g., compression ignition, high compression ratio) to a power mode (e.g., spark ignition, low compression ratio).

Figure 1:
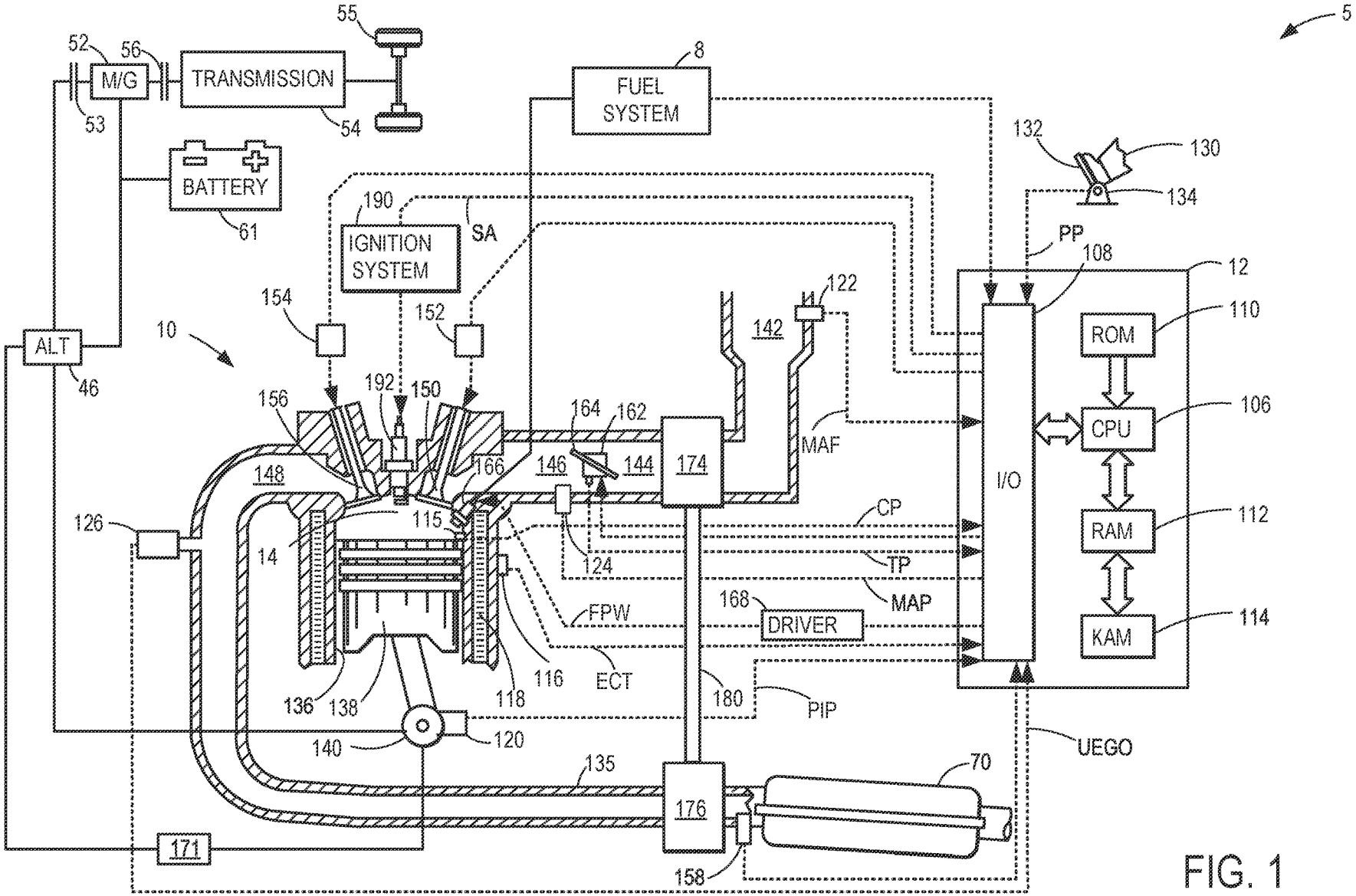
FIG. 1 shows a schematic of an engine included in a vehicle.
Figure 2:
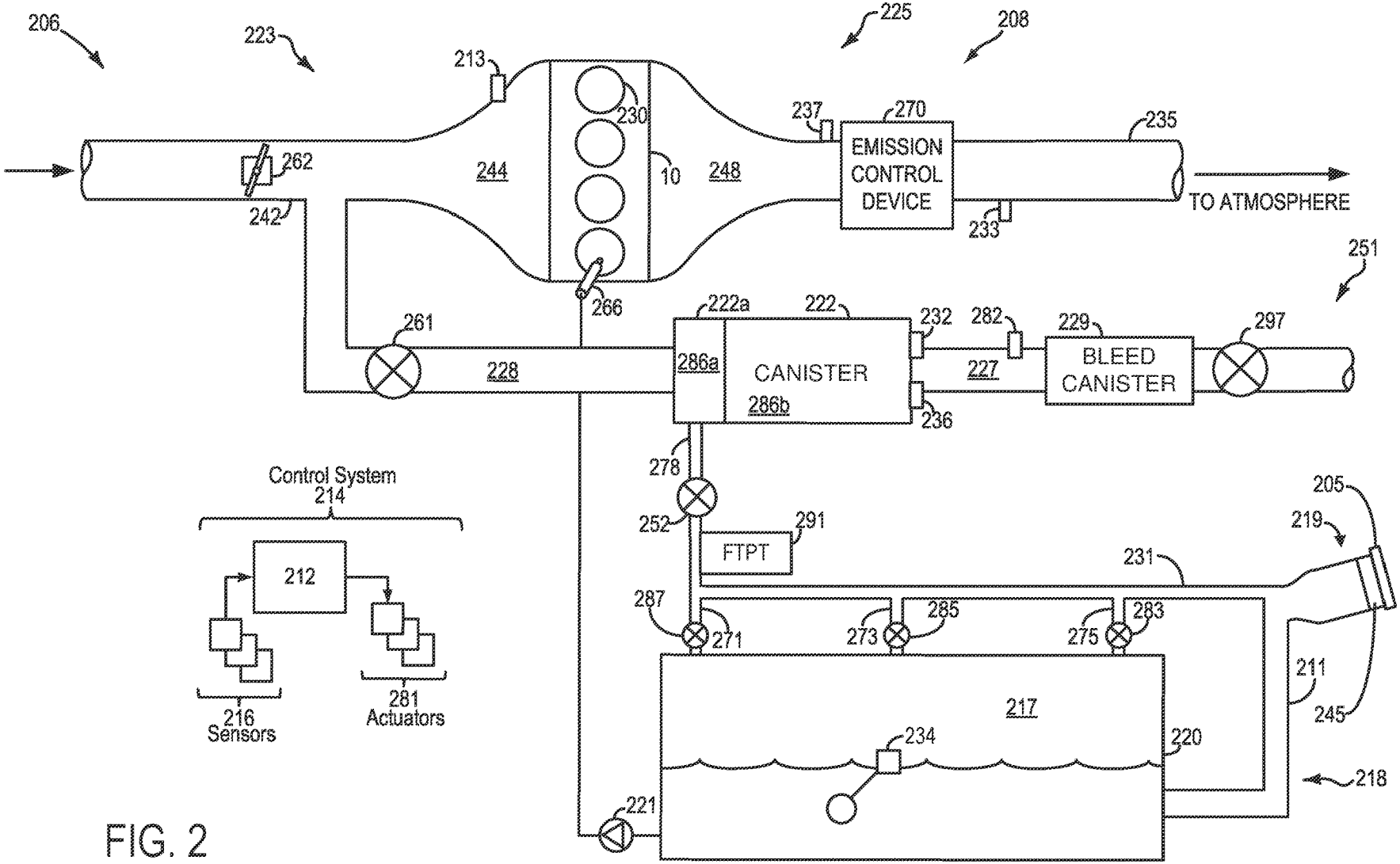
FIG. 2 schematically shows an example vehicle system with a fuel system and an evaporative emissions control system.
Figure 3B:
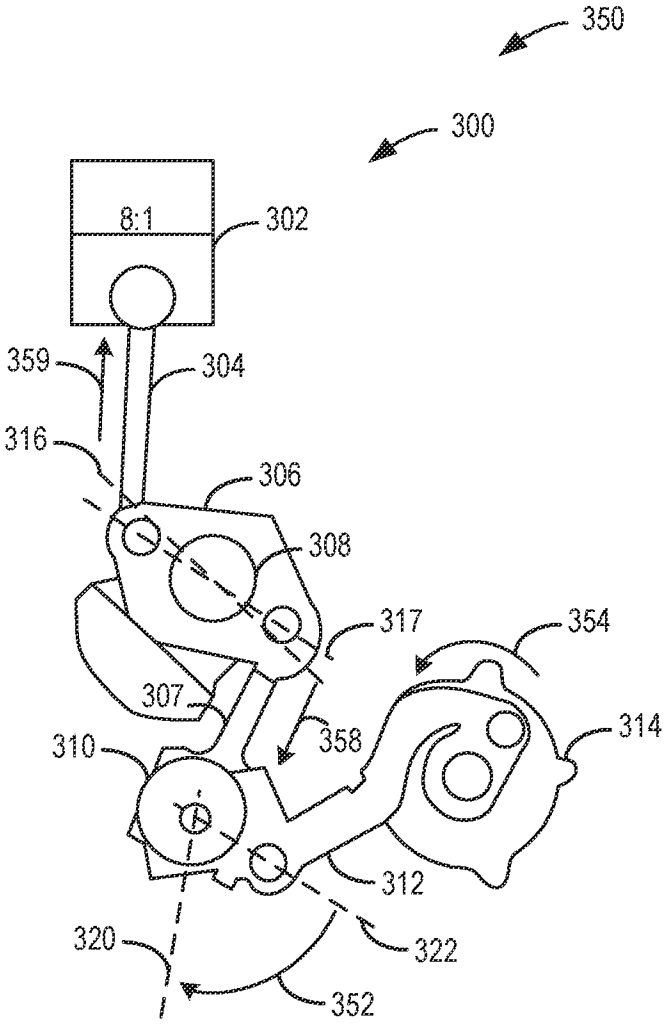
FIG. 3B schematically shows the example piston of the VCE in a second position.
Figure 3A:
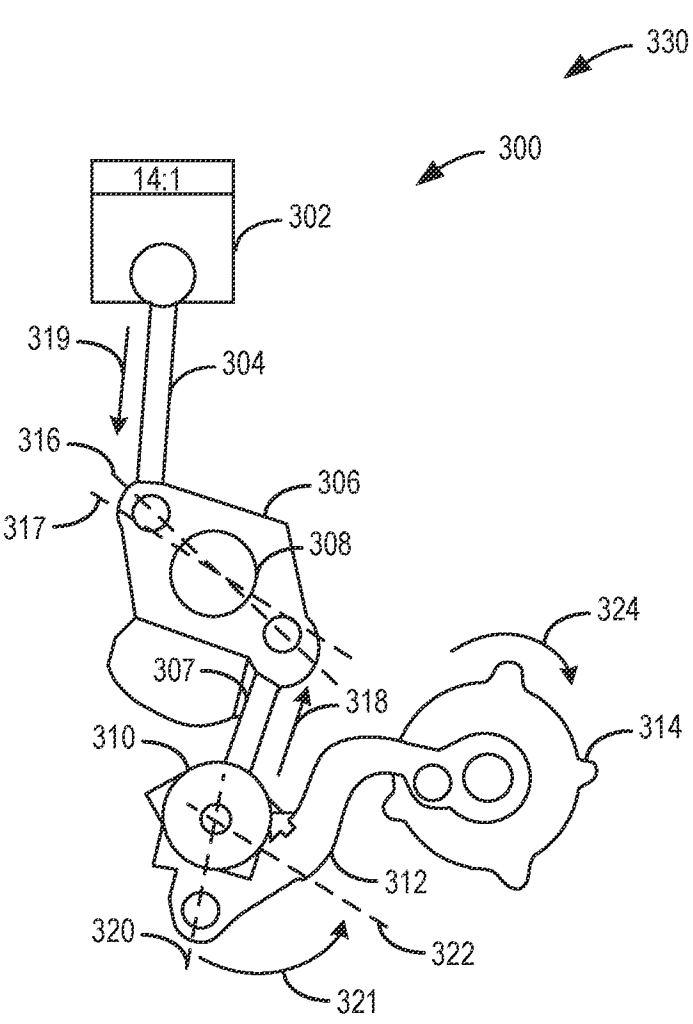
FIG. 3A schematically shows an example piston of a variable compression engine (VCE) in a first position.
Figure 5A:
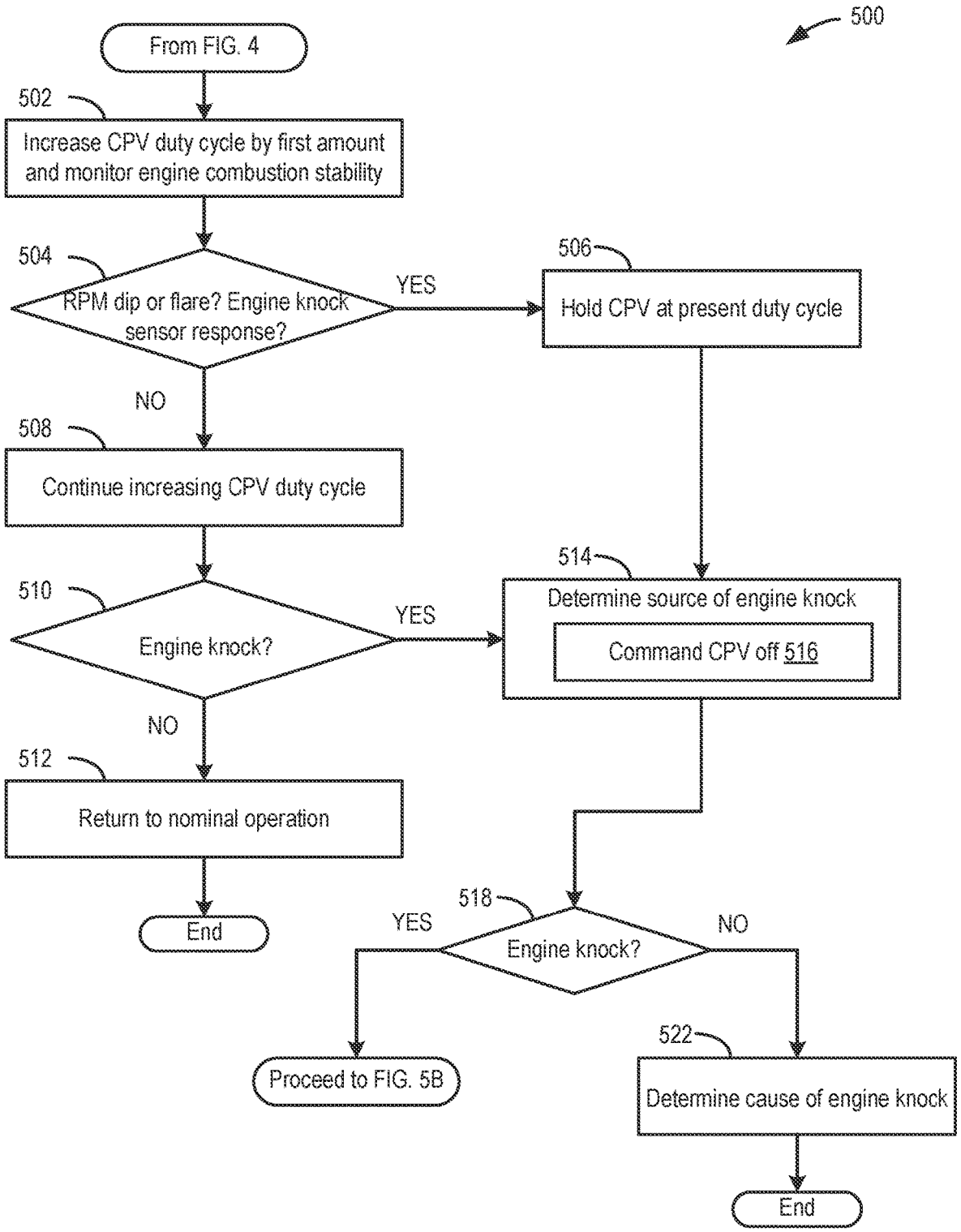
FIGS. 5A-5B show an example method for adjusting an operating mode of the VCE.
Figure 6:
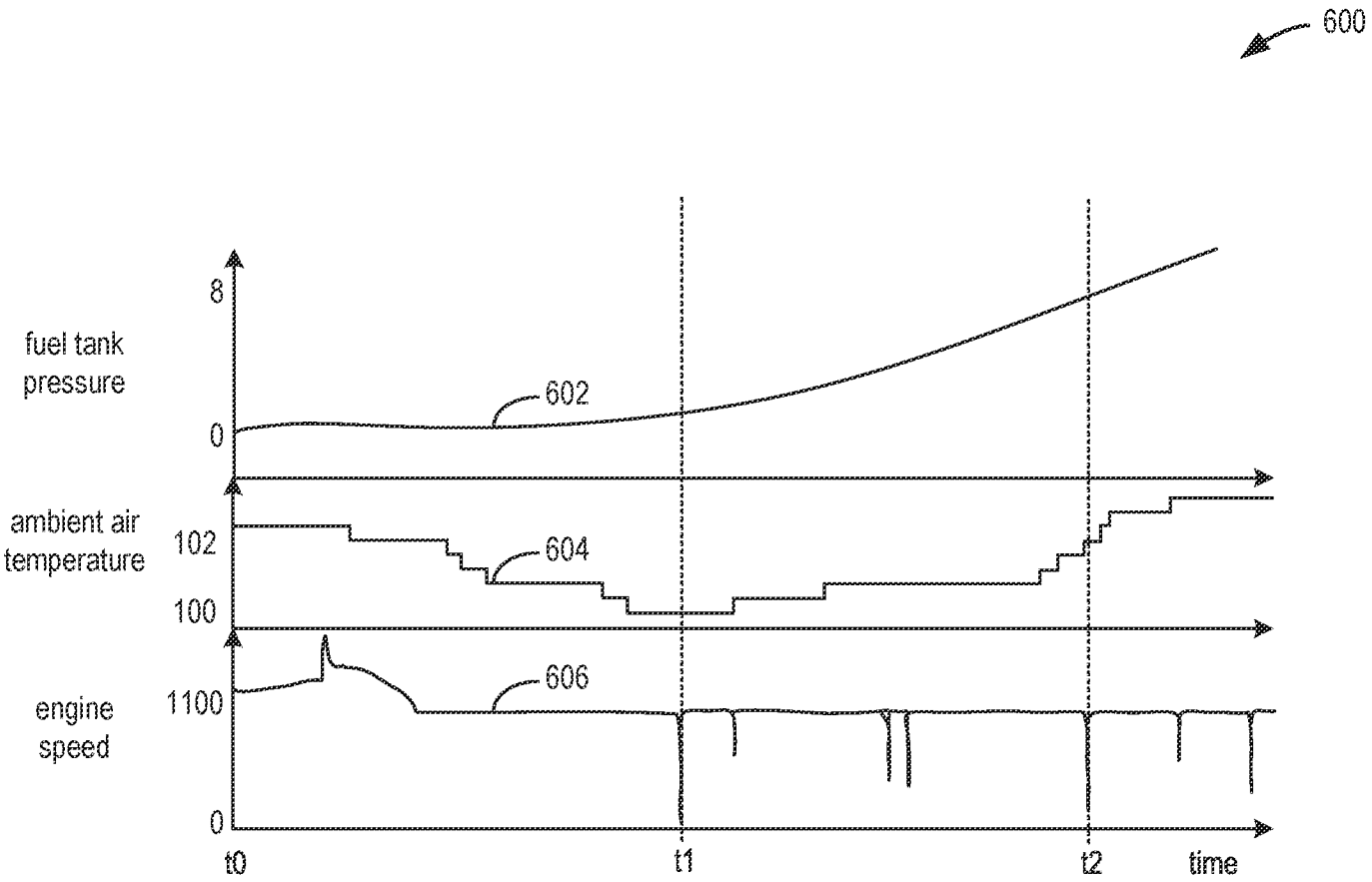
FIG. 6 shows an example graph illustrating a high heat drive cycle.
Figure 7:
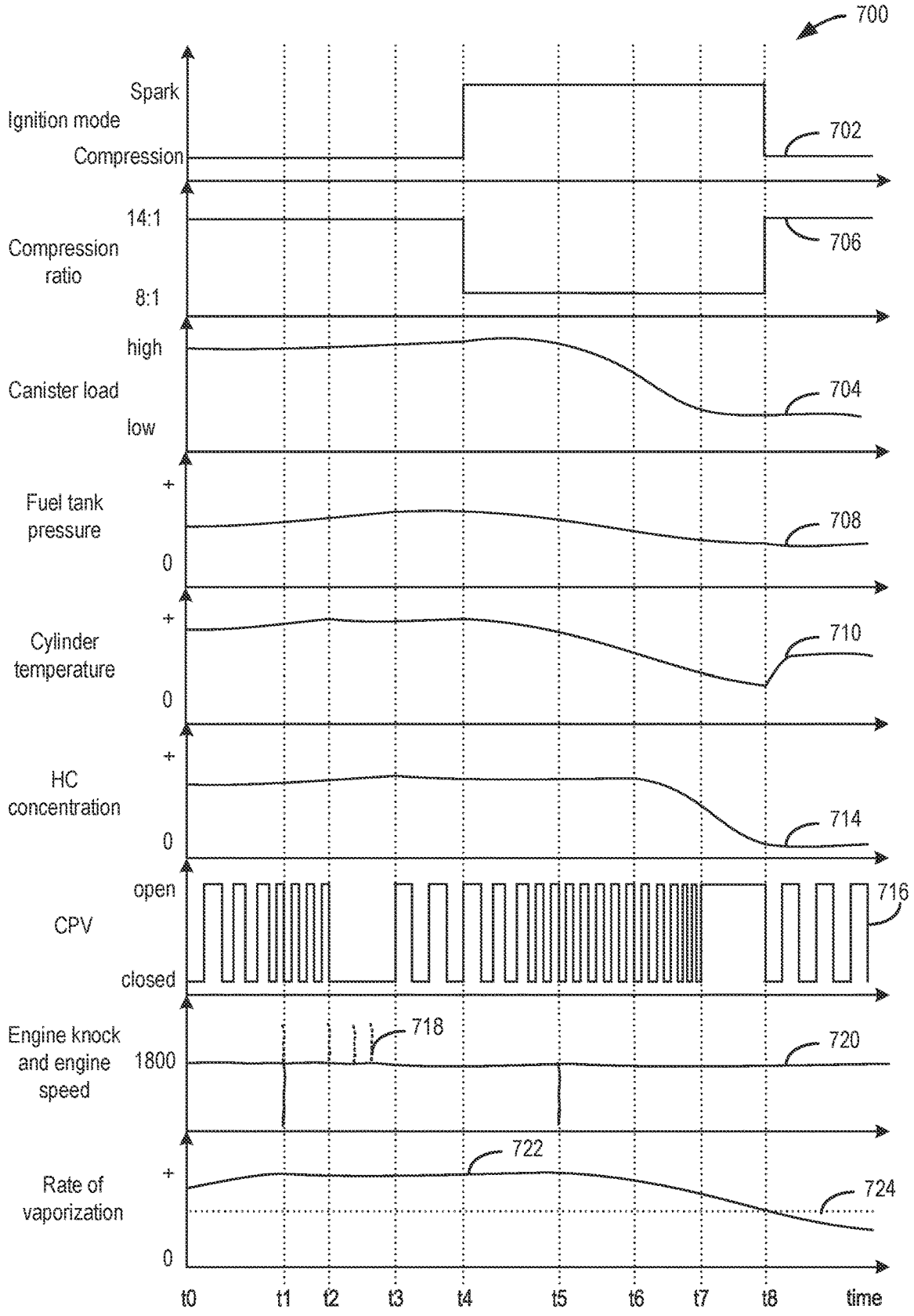
FIG. 7 shows an example graph of VCE operating conditions during implementation of the methods of FIGS. 4 and 5A-5B.

FIG. 1 shows a schematic of an engine included in a vehicle. Herein, the engine may be a VCE wherein the compression ratio may be adjusted between at least a first and a second compression ratio. FIGS. 3A and 3B show a first and a second position of a piston of the VCE, which may represent the first and the second compression ratios, respectively. The vehicle including the VCE may be configured with a fuel system and an evaporative emissions control (EVAP) system, as shown in FIG. 2. A fuel vapor canister may be incorporated in the EVAP system as shown in FIG. 2, and pressure of the fuel system may be monitored by the FTPT to determine a rate of vaporization within the canister. Upon detection of a high rate of vaporization, the operating mode of the VCE may transition from the fuel efficiency mode to the power mode, as described in the methods of FIGS. 4-5B. FIG. 6 shows an example graph illustrating a high heat drive cycle, where high ambient air temperatures may increase the rate of vaporization. FIG. 7 shows an example graph of VCE operating conditions during implementation of the methods of FIGS. 4-5B upon indication of the high vaporization rate by the FTPT.

Turning to the figures, FIG. 1 depicts an example of an internal combustion engine 10, which may be included in a vehicle 5. The engine 10 may be a variable compression engine (VCE), where the vehicle may switch between compression ignition and spark ignition operating modes, as further described in FIGS. 3A-6. In some examples, vehicle 5 may be a hybrid vehicle with multiple sources of torque available to one or more vehicle wheels 55. In other examples, vehicle 5 is a conventional vehicle with only an engine. In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutch is engaged. In the depicted example, a first clutch 53 is provided between crankshaft 140 and electric machine 52, and a second clutch 56 is provided between electric machine 52 and transmission 54. Controller 12 may send a signal to an actuator of each of the first clutch 53 and the second clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission.

The powertrain may be configured in various manners, including as a parallel, a series, or a series-parallel hybrid vehicle. In electric vehicle embodiments, a system battery 61 may be a traction battery that delivers electrical power to electric machine 52 to provide torque to vehicle wheels 55. In some embodiments, electric machine 52 may also be operated as a generator to provide electrical power to charge system battery 61, for example, during a braking operation. It will be appreciated that in other embodiments, including non-electric vehicle embodiments, system battery 61 may be a typical starting, lighting, ignition (SLI) battery coupled to an alternator 46.

FIG. 1 shows one cylinder 14 of engine 10, which may be a multi-cylinder engine and which, in one example, may be a V6 engine. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Vehicle 5 may further include a brake pedal (not shown in FIG. 1), configured to communicate a desired slowing of vehicle speed by actuation of vehicle brakes. The brake pedal may be similarly monitored by a pedal position sensor.

Cylinder (herein, also "combustion chamber") 14 of engine 10 may include combustion chamber walls 136 with a piston 138 positioned therein. Pressure within the cylinder 14 may be determined via a cylinder pressure sensor 115 coupled to the cylinder 14. In one example, the cylinder pressure sensor 115 may be a piezoelectric sensor positioned in a cylinder head of cylinder 14. In another example, the cylinder pressure sensor 115 may be integrated with, e.g., forming a single unit with, a spark plug 192 of cylinder 14. Piston 138 may be coupled to a crankshaft 140 so that reciprocating motion of the piston is translated into rotational motion of the crankshaft. A position of the crankshaft 140 may be determined via a Hall effect sensor (crankshaft signal sensor) 120 coupled to the crankshaft 140. The crankshaft 140 may be coupled to at least one vehicle wheel 55 via a transmission 54, as further described below.

A starting device may be coupled to the crankshaft 140, via a flywheel and a coupling mechanism, such as a chain (not shown), for example, to enable cranking of engine 10. The starting device may be used to start the engine, e.g., rotate the crankshaft 140 and thereby drive piston motion, from a stationary status. In one example, when vehicle 5 is a conventional ICE vehicle or a vehicle with a VCE, the starting device may be a conventional starter motor 171 which may be powered by system battery 61. When engine start (or restart following an idle-stop as described herein) is requested, the starter motor 171 may be energized by the system battery 61 to drive rotation of the crankshaft 140. Fuel combustion at cylinder 14 may commence after the engine is cranked by the starter motor 171 and the starter motor 171 may be deactivated once fuel combustion provides sufficient torque and rotation of the crankshaft is thereby driven by combustion.

The starter motor 171 may be electrically coupled to alternator 46 which may be configured to charge system battery 61 using engine torque via crankshaft 140 during engine operation. In addition, alternator 46 may power one or more electrical systems of the engine, such as one or more auxiliary systems, including a heating, ventilation, and air conditioning (HVAC) system, vehicle lights, an on-board entertainment system, and other auxiliary systems based on their corresponding electrical demands. In one example, a current drawn on the alternator may continually vary based on each of an operator cabin cooling demand, a battery charging requirement, other auxiliary vehicle system demands, and motor torque. A voltage-regulating device may be coupled to alternator 46 and the starter motor 171 in order to dynamically distribute the power output of the alternator based on system usage requirements, including auxiliary system demands.

In other examples, the starting device may be an integrated starter-alternator or integrated starter-generator (ISG), which may be used in hybrid vehicles to provide boost, energy recovery, and enable implementation of start/stop technology. For example, electric machine 52 may be implemented as an ISG and may be coupled to and decoupled from engine 10 by the first clutch 53. In another example, the starting device may be an integrated starter-generator (BISG) which may also be engaged/disengaged from engine 10 by the first clutch 53. For example, electric machine 52 may instead be implemented as a BISG where the BISG is located at a side of engine 10, e.g., a front side, and directly coupled to engine 10 by a drive mechanism, such as a chain. Both the ISG and the BISG may draw electrical energy from system battery 61 to provide torque to crank the engine during engine startup and restart conditions. During other conditions, the ISG or BISG may be operated in the generating mode to charge system battery 61 using excess engine torque.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake poppet valve 150 may be controlled by controller 12 via an intake actuator 152. Similarly, exhaust poppet valve 156 may be controlled by controller 12 via an exhaust actuator 154. The positions of intake poppet valve 150 and exhaust poppet valve 156 may be determined by respective valve position sensors (not shown).

An exhaust manifold 148 can receive exhaust gases from other cylinders of engine 10 in addition to cylinder 14. An exhaust gas sensor 126 is shown coupled to exhaust manifold 148 upstream of an aftertreatment device 70. Exhaust gas sensor 126 may be selected from among various suitable sensors for providing an indication of an exhaust gas air/fuel ratio (AFR), such as a linear oxygen sensor or UEGO (universal or wide-range exhaust gas oxygen), a two-state oxygen sensor or EGO, a HEGO (heated EGO), a NOx, a HC, or a CO sensor, for example. In the example of FIG. 1, exhaust gas sensor 126 is a UEGO sensor. Aftertreatment device 70 may be a three-way catalyst, a NOx trap, various other emission control devices, or combinations thereof. In the example of FIG. 1, aftertreatment device 70 is a three-way catalyst.

Cylinder 14 of engine 10 can receive intake air via a series of intake passages 142 and 144 and an intake manifold 146. Intake manifold 146 can communicate with other cylinders of engine 10 in addition to cylinder 14. One or more of the intake passages may include one or more boosting devices, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 135. Compressor 174 may be at least partially powered by exhaust turbine 176 via a shaft 180 when the boosting device is configured as a turbocharger. However, in other examples, such as when engine 10 is provided with a supercharger, compressor 174 may be powered by mechanical input from the engine, and exhaust turbine 176 may be optionally omitted. In still other examples, engine 10 may be provided with an electric supercharger (e.g., an "eBooster"), and compressor 174 may be driven by an electric motor.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 1, or may be alternatively provided upstream of compressor 174.

During operation, each cylinder within engine 10 typically undergoes a four stroke cycle which includes the intake stroke, compression stroke, expansion (herein, also "power") stroke, and exhaust stroke. During the intake stroke, generally, the exhaust poppet valve 156 closes and intake poppet valve 150 are open. Air is introduced into cylinder 14 via intake manifold 146, and piston 138 moves to the bottom of the cylinder so as to increase the volume within cylinder 14. The position at which piston 138 is near the bottom of the cylinder and at the end of its stroke (e.g. when cylinder 14 is at its largest volume) is referred to by those of skill in the art as bottom dead center (BDC).

During the compression stroke, intake poppet valve 150 and exhaust poppet valve 156 are closed. Piston 138 moves toward the cylinder head so as to compress the air within cylinder 14. The point at which piston 138 is at the end of its stroke and closest to the cylinder head (e.g. when cylinder 14 is at its smallest volume) is referred to by those of skill in the art as top dead center (TDC). In a process hereinafter referred to as injection, fuel is introduced into the combustion chamber. In a process hereinafter referred to as ignition, the injected fuel is ignited by known ignition means such as by spark plug 192 or by compression of injected fuel, resulting in combustion.

During the expansion (power) stroke, the expanding gases push piston 138 back to BDC. Crankshaft 140 converts piston movement into a rotational torque of the rotary shaft. Finally, during the exhaust stroke, the exhaust poppet valve 156 opens to release the combusted air-fuel mixture to exhaust manifold 148 and the piston returns to TDC. Note that the above is shown merely as an example, and that intake and exhaust valve opening and/or closing timings may vary, such as to provide positive or negative valve overlap, late intake valve closing, or various other examples.

During some conditions, controller 12 may vary the signals provided to intake actuator 152 and exhaust actuator 154 to control the opening and closing of the respective intake and exhaust valves. For example, valve actuators may be a cam actuation type and the intake and exhaust valve timing may be controlled concurrently, and any of a possibility of variable intake cam timing, variable exhaust cam timing, dual independent variable cam timing, or fixed cam timing may be used in conjunction with multiple cam profiles or oscillating cams. In some examples, the cam actuation system may be a single cam and may utilize one or more of cam profile switching (CPS), variable cam timing (VCT), variable valve timing (VVT), and/or variable valve lift (VVL) systems that may be operated by controller 12 to vary valve operation. In yet other examples, a camless system may be used and the intake actuator 152 and exhaust actuator 154 may be electronically controlled. For example, the valves may be electro-pneumatic valves, electro-hydraulic valves, or electromagnetic valves.

Cylinder 14 can have a compression ratio, which is a ratio of volumes when piston 138 is at bottom dead center (BDC) to top dead center (TDC). In one example, the compression ratio is in the range of 8:1 to 14:1. However, in some examples, the compression ratio may be increased when different fuels are used. This may happen, for example, when higher octane fuels or fuels with a higher latent enthalpy of vaporization are used. The compression ratio may also be increased if direct injection is used due to its effect on engine knock. In another example further described herein, the compression ratio may be adjusted by adjusting available combustion space, as described in FIGS. 3A-3B, such that different compression ratios may be used under different combustion ignition modes.

Each cylinder of engine 10 may include spark plug 192 for initiating combustion. An ignition system 190 can provide an ignition spark to cylinder 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed and engine load, into a look-up table and output the corresponding MBT timing for the input engine operating conditions. In other examples, spark may be retarded from MBT, such as to expedite catalyst warm-up during engine start or to reduce an occurrence of engine knock. As further described herein, compression ignition may be used instead of spark ignition to initiate combustion during some engine operating modes.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to a pulse width of a signal FPW received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

In an alternate example, fuel injector 166 may be arranged in an intake passage rather than coupled directly to cylinder 14 in a configuration that provides what is known as port injection of fuel (hereafter also referred to as "PFI") into an intake port upstream of cylinder 14. In yet other examples, cylinder 14 may include multiple injectors, which may be configured as direct fuel injectors, port fuel injectors, or a combination thereof. As such, it should be appreciated that the fuel systems described herein should not be limited by the particular fuel injector configurations described herein by way of example.

Fuel injector 166 may be configured to receive different fuels from fuel system 8 in varying relative amounts as a fuel mixture and may be further configured to inject this fuel mixture directly into cylinder 14. Further, fuel may be delivered to cylinder 14 during different strokes of a single cycle of the cylinder. For example, directly injected fuel may be delivered at least partially during a previous exhaust stroke, during an intake stroke, and/or during a compression stroke. As such, for a single combustion event, one or multiple injections of fuel may be performed per cycle. The multiple injections may be performed during the compression stroke, intake stroke, or any appropriate combination thereof in what is referred to as split fuel injection.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof, etc. One example of fuels with different heats of vaporization includes gasoline as a first fuel type with a lower heat of vaporization and ethanol as a second fuel type with a greater heat of vaporization. In another example, the engine may use gasoline as a first fuel type and an alcohol-containing fuel blend, such as E85 (which is approximately 85% ethanol and 15% gasoline) or M85 (which is approximately 85% methanol and 15% gasoline), as a second fuel type. Other feasible substances include water, methanol, a mixture of alcohol and water, a mixture of water and methanol, a mixture of alcohols, etc. In still another example, both fuels may be alcohol blends with varying alcohol compositions, wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities, such as a difference in temperature, viscosity, octane number, etc. Moreover, fuel characteristics of one or both fuel tanks may vary frequently, for example, due to day to day variations in tank refilling.

Controller 12, which may include a powertrain control module (PCM), is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; a cylinder pressure (CP) from a cylinder pressure sensor 115; an engine coolant temperature (ECT) from a temperature sensor 116 coupled to a cooling sleeve 118; an exhaust gas temperature from a temperature sensor 158 coupled to exhaust passage 135; a profile ignition pickup signal (PIP) from a Hall effect sensor 120 (or other type) coupled to crankshaft 140; a throttle position signal (TP) from a throttle position sensor; signal UEGO from exhaust gas sensor 126, which may be used by controller 12 to determine the AFR of the exhaust gas; engine knock within the cylinder from an engine knock sensor (not shown); and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature and infer a temperature of after-treatment device 70 based on the signal received from temperature sensor 158.

Controller 12 receives signals from the various sensors of FIG. 1, processes the received signals, and employs the various actuators of FIG. 1 (e.g., fuel injector 166 and spark plug 192) to adjust engine operation based on the received signals and instructions stored on a memory of the controller. In one example, in response to a lower than threshold engine load for a longer than threshold duration, the controller may initiate an engine idle-stop by sending a signal to the fuel injectors 166 to suspend engine cylinder fuel injection. In another example, in response to a request for engine restart, the controller may send a signal to an actuator of the starting device to activate the starting device. Further in response to the request for engine restart, a spark ignition timing may be adjusted according to an estimated fuel-air equivalence ratio (phi) and an estimated cylinder turbulence to enable fuel combustion during a power stroke of one or more cylinders, thereby reducing a load on the starting device.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

FIG. 2 shows a schematic depiction of a vehicle system 206. It may be understood that vehicle system 206 may comprise the same vehicle system as vehicle system 100 depicted at FIG. 1. The vehicle system 206 includes an engine system 208 coupled to an evaporative emissions control (EVAP) system 251 and a fuel system 218. It may be understood that fuel system 218 may comprise the same fuel system as fuel system 8 depicted at FIG. 1. EVAP system 251 includes a fuel vapor storage container or canister 222 which may be used to capture and store fuel vapors. In some examples, vehicle system 206 may be a hybrid electric vehicle system. However, it may be understood that the description herein may refer to a non-hybrid vehicle, for example a vehicle only equipped with an engine, such as a VCE, and not an onboard energy storage device, without departing from the scope of the present disclosure.

The engine system 208 may include the engine 10 having a plurality of cylinders 230. The engine 10 includes an engine air intake 223 and an engine exhaust system 225. The engine air intake 223 includes a throttle 262 in fluidic communication with engine intake manifold 244 via an intake passage 242. Further, engine air intake 223 may include an air box and filter (not shown) positioned upstream of throttle 262. The engine exhaust system 225 includes an exhaust manifold 248 leading to an exhaust passage 235 that routes exhaust gas to the atmosphere. The engine exhaust system 225 may include one or more emission control device 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors. For example, a barometric pressure sensor 213 may be included in the engine intake. In one example, barometric pressure sensor 213 may be a manifold air pressure (MAP) sensor and may be coupled to the engine intake downstream of throttle 262. Barometric pressure sensor 213 may rely on part throttle or full or wide open throttle conditions, e.g., when an opening amount of throttle 262 is greater than a threshold, in order accurately determine BP.

Fuel system 218 may include a fuel tank 220 coupled to a fuel pump system 221. It may be understood that fuel tank 220 may comprise a fuel tank of fuel system 8 depicted above at FIG. 1. The fuel pump system 221 may include one or more pumps for pressurizing fuel delivered to the injectors of engine 10, such as the example injector 266 shown. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may occupy a vapor space 217 of the fuel tank 220 and be routed to an EVAP system 251 which includes a fuel vapor canister 222 via vapor recovery line 231, before being purged to the engine air intake 223. A rate at which vapor is generated is herein referred to as a rate of vaporization. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves may be positioned in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill threshold venting valve (FLVV) 285, and conduit 275 may include a grade vent valve (GVV) 283. Further, in some examples, vapor recovery line 231 may be coupled to a refueling system 219. In some examples, refueling system 219 may include a fuel cap 205 for sealing off the fuel filler system from the atmosphere. Refueling system 219 is coupled to fuel tank 220 via a fuel filler pipe 211. In some examples, conduit 278 directly coupled to fuel tank without fuel tank vent vales and/or the fuel tank may be capless.

Further, refueling system 219 may include refueling lock 245. In some examples, refueling lock 245 may be a fuel cap locking mechanism (e.g., when a fuel cap is included). The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some examples, refueling lock 245 may be a filler pipe valve located at a mouth of fuel filler pipe 211. In such examples, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some examples, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In examples where refueling lock 245 is locked using an electrical mechanism, refueling lock 245 may be unlocked by commands from controller 212, for example, when a fuel tank pressure decreases below a pressure threshold. In examples where refueling lock 245 is locked using a mechanical mechanism, refueling lock 245 may be unlocked via a pressure gradient, for example, when a fuel tank pressure decreases to atmospheric pressure.

EVAP system 251 may include one or more emissions control devices, such as one or more fuel vapor canisters 222 filled with an appropriate adsorbent 286*b*, the canisters are configured to temporarily trap fuel vapors (including vaporized hydrocarbons) during fuel tank refilling operations and "running loss" (that is, fuel vaporized during vehicle operation). In one example, the adsorbent 286*b* used is activated charcoal. EVAP system 251 may further include a canister ventilation path or vent line 227 which may route gases out of the canister 222 to the atmosphere when storing, or trapping, fuel vapors from fuel system 218.

Canister 222 may include a buffer 222*a* (or buffer region), each of the canister and the buffer comprising the adsorbent. As shown, the volume of buffer 222*a* may be smaller than (e.g., a fraction of) the volume of canister 222. The adsorbent 286*a* in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the potential of increased fuel vapor spikes going to the engine.

One or more temperature sensors 232 may be coupled to and/or within canister 222. In one example, temperature sensor 232 is a thermocouple and is positioned at the outlet of the canister. As fuel vapor is adsorbed by the adsorbent in the canister, heat is generated (e.g., heat of adsorption). Likewise, as fuel vapor is desorbed by the adsorbent in the canister, heat is consumed. In this way, the adsorption and desorption of fuel vapor by the canister may be monitored and estimated based on temperature changes within the canister.

A hydrocarbon (HC) sensor 236 may be placed at the output of a fresh air port of the canister (e.g., a port coupling the canister to atmosphere). In one example, the HC sensor 236 may be positioned adjacent to or opposite the temperature sensor 232 in the vent line 227. In one example, if HC breakthrough is detected by the HC sensor (e.g., the HC sensor detects HC in the vent line 227) the engine may be commanded to perform a canister purge operation. In the example disclosed herein, HC breakthrough above a threshold may indicate to the controller to perform a canister purge operation, where the threshold is a positive, non-zero HC concentration.

Vent line 227 may also allow fresh air to be drawn into canister 222 when purging stored fuel vapors from fuel system 218 to engine air intake 223 via purge line 228 and a canister purge valve (CPV) 261. For example, CPV 261 may be normally closed but may be opened during certain conditions so that vacuum from engine intake manifold 244 is provided to the fuel vapor canister for purging. A bleed canister 229 may be positioned within vent line 227 between a canister vent valve 297 and the canister 222. The bleed canister 229 may trap fuel vapor not trapped by the canister 222 due to overloading of the canister 222. Herein, the bleed canister 229 and canister 222 may be jointly referred to as "canister" and methods applied to purge the canister 222 may also be applied to the bleed canister 229. A rate at which trapped fuel vapors are desorbed from the canister is herein referred to as a rate of desorption.

In some examples, the flow of air and vapors between canister 222 and the atmosphere may be controlled by the canister vent valve 297 coupled within vent line 227. In one example, the canister vent valve 297 is a canister vent solenoid valve (CVS). In examples where the canister vent valve is a CVS, as described herein, CVS 297 may be a solenoid valve wherein opening or closing of the valve is performed via actuation of a canister vent solenoid. In particular, the CVS may be an open valve that is closed upon actuation of the canister vent solenoid. In some examples, CVS 297 may be configured as a latchable solenoid valve. In other words, when the valve is placed in a closed configuration, it latches closed without requiring additional current or voltage. For example, the valve may be closed with a 100 ms pulse, and then opened at a later time point with another 100 ms pulse. In this way, the amount of battery power required to maintain the CVS closed is reduced. In particular, the CVS may be closed while the vehicle is off, thus maintaining battery power while maintaining the fuel emissions control system sealed from atmosphere.

As described above, the CVS 297 may be a normally open valve so that a fuel tank isolation valve (FTIV) 252 may control venting of fuel tank 220 with the atmosphere. FTIV 252 may be positioned between the fuel tank and the fuel vapor canister 222 within conduit 278. FTIV 252 may be a normally closed valve, that when opened, allows for the venting of fuel vapors from fuel tank 220 to fuel vapor canister 222. For example, the FTIV 252 may be a vapor balance valve (VBV). Fuel vapors may then be vented to atmosphere, or purged to engine air intake 223 via CPV 261.

A fuel tank pressure transducer (FTPT) 291 may be positioned in the conduit 278 between the vapor recovery line 231 and the VBV 252. The FTPT 291 may determine pressure of the fuel system and/or the EVAP system. For example, the FTPT 291 may determine fuel system pressure when the VBV 252 is closed and may determine EVAP system pressure when the VBV 252 is open and the CPV 261 is closed.

Fuel system 218 may be operated by controller 212 in a plurality of modes by selective adjustment of the various valves and solenoids. It may be understood that control system 214 may comprise the same control system as controller 12 depicted above at FIG. 1. For example, the fuel system may be operated in a fuel vapor storage mode (e.g., during a fuel tank refueling operation and with the engine not combusting air and fuel), wherein the controller 212 may open VBV 252 (when included) while closing CPV 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open VBV 252 (when included), while maintaining CPV 261 closed, to depressurize the fuel tank before allowing enabling fuel to be added therein. As such, VBV 252 (when included) may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine combusting air and fuel), wherein the controller 212 may open CPV 261 while closing VBV 252 (when included). Herein, the vacuum generated by the intake manifold of the operating engine may be used to draw fresh air through vent line 227 and through fuel vapor canister 222 to purge the stored fuel vapors into the engine intake manifold 244. In this mode, the purged fuel vapors from the canister are combusted in the engine. The purging may be continued until the stored fuel vapor amount in the canister is below a threshold amount, for example, an amount wherein HC breakthrough is not detected.

Controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device 270, fuel system temperature sensor 233, FTPT 291, pressure sensor 282, HC sensor 236, and canister temperature sensor 232 (e.g., thermocouple). Other sensors such as pressure, temperature, air/fuel ratio, and composition sensors may be coupled to various locations in the vehicle system 206. As another example, the actuators may include throttle 262, VBV 252, CPV 261, and CVS 297. The control system 214 may include a controller 212. The controller may receive input data from the various sensors, process the input data, and trigger the actuators in response to the processed input data based on instruction or code programmed therein corresponding to one or more routines. Example control routines are described herein with regard to FIG. 4 and FIGS. 5A-5B.

As briefly described above, the engine may be a VCE, enabling the vehicle to switch between compression ignition, which may be homogeneous charge compression ignition, and spark ignition operating modes. A VCE may be used to decrease emissions while maintaining or increasing vehicle power output, which may be achieved by adjusting a piston stroke, and therefore a compression ratio, to increase fuel efficiency while maintaining or increasing torque. As shown in FIGS. 3A and 3B, a VCE mechanism 300 may be a piston 302 configured with an upper link 304, a multi-link 306, a lower link 307, a control shaft 310, an actuator arm 312, and a harmonic drive 314. The multi-link 306 may be positioned around and in communication with a crankshaft 308 of the engine. The piston 302 may be positioned within an engine cylinder, such as a cylinder 230 of FIG. 2, and may be actuated during an engine cycle, for example, the four stroke cycle described in FIG. 1.

The VCE may have at least two operating modes. A first operating mode may be a fuel efficiency mode, where spark is deactivated and a compression ratio is increased such that fuel may auto-ignite, with auto-ignition timing optionally controlled by controlling air temperature and/or pressure and fuel injection timing early to enable mixing during the intake and compression strokes. For example, the compression ratio may be 14:1 during the fuel efficiency mode. During the fuel efficiency mode, if pressure and temperature within the cylinder are high enough, fuel not yet combusted by a first flame front (e.g., generated from compression ignition) may auto-ignite, creating a second flame front. When the first flame front and the second flame front meet, engine knock may occur. A second operating mode may be a power mode, where spark is activated to ignite fuel and a compression ratio is decreased. For example, the compression ratio may be 8:1, which may aid in reducing pre-ignition of fuel (e.g., ignition of fuel prior to spark) due to fuel compression. Additionally, cylinder temperature may be lower during spark ignition compared to during compression ignition. However, as fuel ignited by spark ignition burns, cylinder temperature and cylinder pressure may increase to a point where fuel in the cylinder that has not yet been burned by a first, spark-ignited flame front may auto-ignite. Auto-ignition of fuel may result in a second flame front and, when the first flame front and the second flame front meet, engine knock may occur.

FIG. 3A shows the VCE mechanism in a first position 330 for the fuel efficiency mode. FIG. 3B shows the VCE mechanism in a second position 350 for the power mode. In one example, the fuel efficiency mode may be implemented during light loads when cylinder temperatures are low. The power mode may be implemented during high load or engine boost conditions, which may aid in reducing engine knock. The VCE may nominally operate in the fuel efficiency mode, for example, during vehicle idle or cruise. The VCE may operate in the power mode when power demand is high, for example, during acceleration, while driving up a steep gradient, when hauling additional weight, and so on. As further described below in FIGS. 4-5B, the VCE may switch from the fuel efficiency mode to the power mode when a high rate of vaporization is inferred, which may reduce evaporative emissions, pre-ignition of fuel, and engine knock.

When a change in compression ratio is requested, for example, during a change in ignition mode from compression ignition to spark ignition as further described below, the VCE mechanism may transition from the first position 330 to the second position 350. The harmonic drive 314 may turn as shown by arrow 324 of FIG. 5A, which moves the actuator arm 312 from a first position 320 to a second position 322, as shown by arrow 321. Movement of the actuator arm 312 rotates the control shaft 310, which acts upon the lower link 307 to change an angle of the multi-link 306 from a third position 316 to a fourth position 317, as shown by arrow 318. Movement of the multi-link 306 adjusts a height of the piston 302 by moving the upper link 304 down, as shown by arrow 319. In this way, the VCE mechanism adjusts the compression ratio from a first compression ratio (e.g., 14:1) used in the fuel efficiency mode, as shown in the first position 330 of FIG. 3A, to a second compression ratio (e.g., 8:1) used in the power mode, as shown in the second position 350 of FIG. 3B.

The VCE mechanism may transition from the power mode shown in FIG. 3B to the fuel efficiency mode shown in FIG. 3A via an inverse process. For example, when a change from a low to high compression ratio is requested (e.g., a request to transition the VCE from power mode to fuel efficiency mode), the harmonic drive 314 may turn as shown by arrow 354 of FIG. 5B. Movement of the harmonic drive 314 moves the actuator arm 312 from the second position 322 to the first position 320, as shown by arrow 352. Movement of the actuator arm 312 rotates the control shaft 310, which acts upon the lower link 307 to change an angle of the multi-link 306 from the fourth position 317 to the third position 316, as shown by arrow 358. Movement of the multi-link 306 adjusts a height of the piston 302 by moving the upper link 304 up, as shown by arrow 359. In this way, the VCE mechanism adjusts the compression ratio from the second compression ratio used in the power mode, as shown in the second position 350 of FIG. 3B, to the first compression ratio used in the fuel efficiency mode, as shown in the first position 330 of FIG. 3A. VCE mechanisms other than the mechanism described herein may be similarly implemented to adjust compression ratios and switch between spark ignition and compression ignition operating modes without departing from the scope of this disclosure.

Vehicle emission control systems may be configured to store refueling vapors, running-loss vapors, and diurnal emissions in a fuel vapor canister, and then purge the stored vapors during a subsequent engine operation. During canister purging, stored vapors may be routed to engine intake for combustion, further improving fuel economy for the vehicle. In a typical canister purge operation, a CPV coupled between the engine intake and the fuel vapor canister is opened, allowing an intake manifold vacuum to be applied to the fuel vapor canister. Fresh air may be drawn through the fuel vapor canister via an open canister vent valve (herein, the CVS). Fresh air may displace vapors trapped in the canister and the vapors may be sucked into the intake manifold to be combusted in the engine. This configuration facilitates desorption of stored fuel vapors from the adsorbent material in the canister, regenerating the adsorbent material for further fuel vapor adsorption.

However, a canister may not be fully purged during canister purging operations, as airflow within the canister may not be uniform. For example, some regions within the canister may experience more air flow than other regions in the same canister. Regions experiencing less air flow or less frequent air flow may retain hydrocarbon (HC) vapor after purging operations. Retained HC vapor may contribute to bleed emissions, such that evaporative emissions are bled to the atmosphere and/or engine instead of trapped in the canister and routed through an emission control device during purging. In some examples, HC vapors may bleed more readily from the canister when vehicle temperatures, including temperatures of the fuel tank, canister, and EVAP system are high, such as when a vehicle is parked over two to three days in hot climates. If the vehicle is refueled, saturating the canister with fuel vapor, and then parked in a hot, sunny location prior to a purge event, the canister may desorb fuel vapors as it warms up, leading to bleed emissions. In another example, in hybrid electric vehicles (HEV) and plug-in hybrid vehicles where engine run time may be less than engine run time in non-HEVs (e.g., less than half), opportunities for purging fuel vapor from the canister may also be reduced compared to purging opportunities in non-HEVs, and HC vapors may contribute to bleed emissions when the canister is overloaded, which may be due to infrequent purging.

One example of a method to infer HC breakthrough and implement action to reduce HC vapor bleed includes placing an HC sensor at the output of a fresh air port of the canister (e.g., a port coupling the canister to atmosphere), as described in FIG. 2. If HC breakthrough is detected by the HC sensor, the engine may be commanded to perform a canister purge operation.

Canister purging operations are further challenged in systems that implement a VCE, where the vehicle may switch between compression ignition and spark ignition operating modes. For example, when a VCE is operating in a compression ignition mode, fuel vapors (e.g., HC vapors) may enter engine cylinders and ignite prematurely due to high cylinder temperature and pressure. Premature ignition (e.g., pre-ignition) of vapors may cause poor combustion due to potential interference with injector fueling and may degrade the engine piston by generating combustion torque which may act against a direction of piston movement. Ideally, it is desired for injected fuel to form a cone prior to compression ignition and premature vapor ignition may interfere with timing of injected fuel ignition. In some drive cycles, when vapors prematurely ignite, the rate of fuel vaporization may be greater than the ability of the engine to purge the canister, which may be measured by the rate of desorption. For example, if a user refuels a hot engine on a hot day and the ensuing drive cycle results in activation of the VCE, excess vapor from the evaporative emissions control (EVAP) system may overload the canister and result in an increase in evaporative emissions. In another example, a presence of HC vapors during the compression ignition mode may cause knock when injected fuel combustion is started by compression ignition and auto-ignition of HC vapors generates a second flame front. When a flame front from compression ignition of injected fuel and the second flame front from auto-ignition of HC vapors meet, knock may occur.

Operating the VCE in the fuel efficiency mode may result in more heat generation within the cylinder due to the higher compression ratio, compared to the power mode. As a result, fuel in the cylinder (e.g., injected fuel) may auto-ignite, as described above. If HC vapor bleeds into the canister during this auto-ignition condition, HC vapor may auto-ignite and form a separate flame front from the already combusting fuel, which may result in poor combustion and engine knock, as described above. Alternatively, if the VCE is in the power mode (e.g., spark ignition), increasing cylinder temperature due to high ambient temperature may result in auto-ignition of fuel. In this example, auto-ignition may result in a second flame kernel (e.g., where a first flame kernel is the result of spark ignition). Collision of a first flame front of the first flame kernel and a second flame front of the second flame kernel may result in engine knock, which may degrade the engine over time. Therefore, a method is desired for maintaining engine power while reducing evaporative emissions, pre-ignition of fuel, and engine knock.

Figure 4:
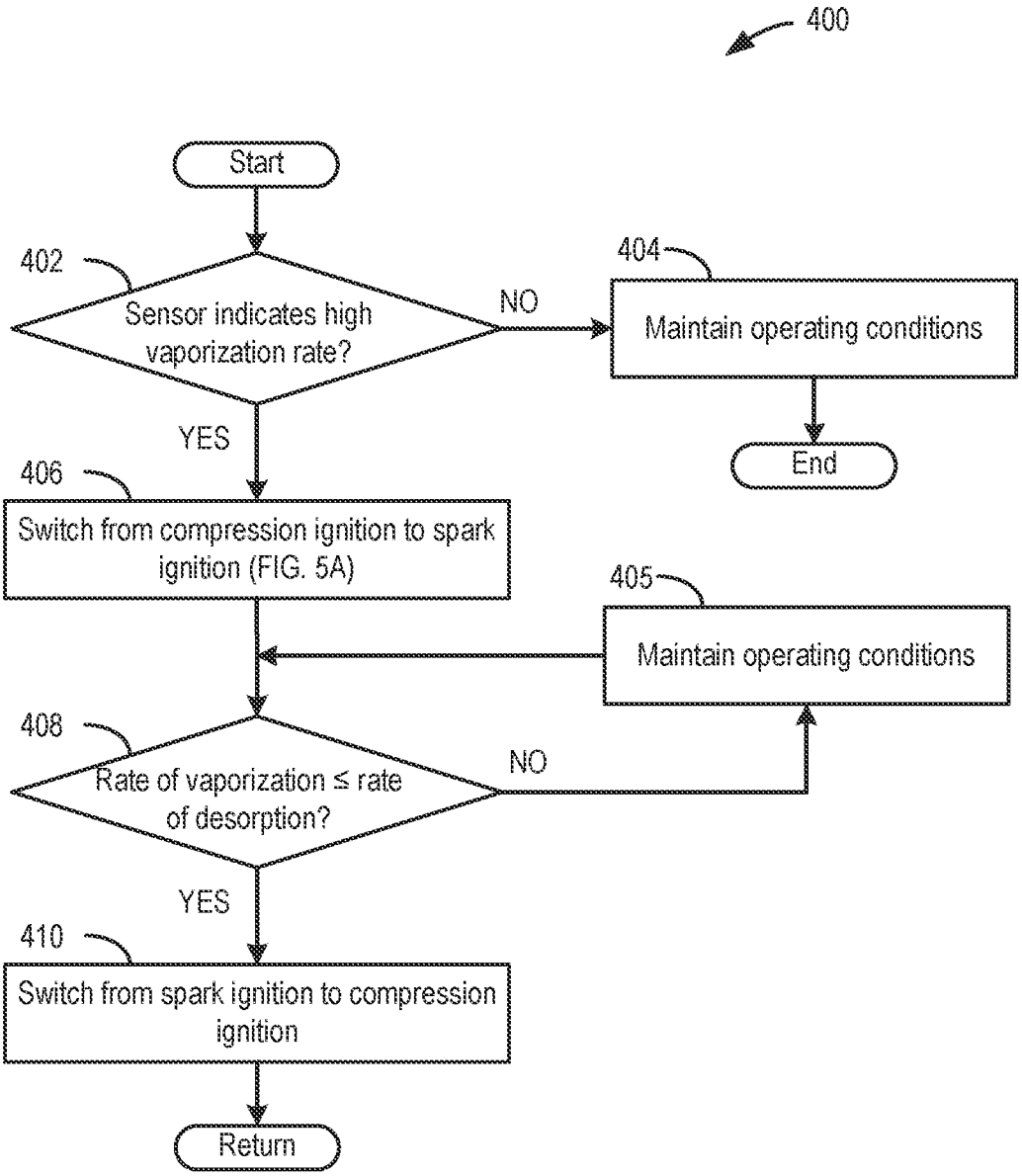
FIG. 4 shows an example method for inferring a rate of fuel vaporization and performing mitigation to prevent increased levels of evaporative emissions.
Figure 5B:
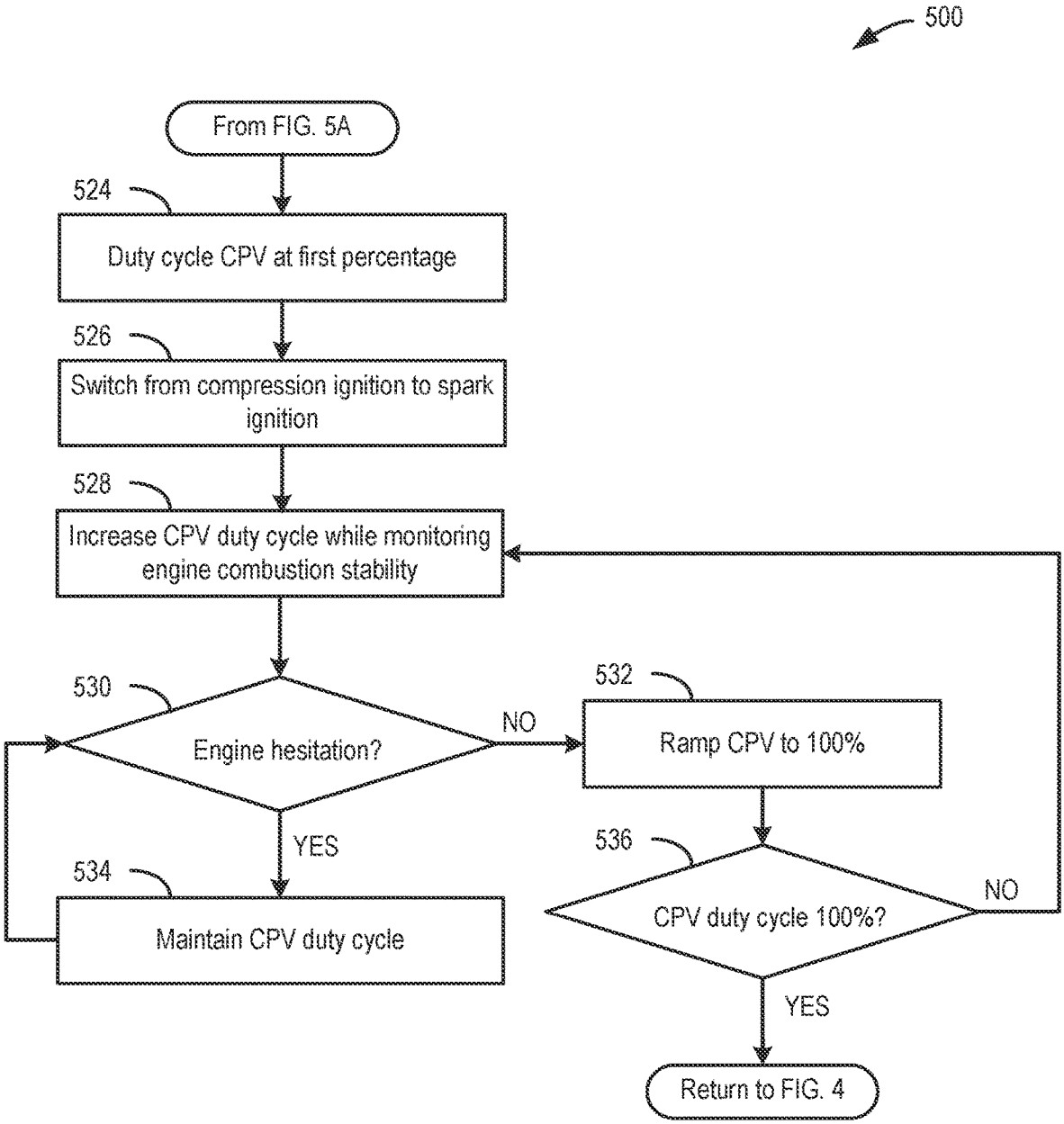

FIGS. 4-5B show example methods for reducing potential HC breakthrough conditions by inferring a high rate of vaporization and performing mitigation to prevent increased levels of evaporative emissions. Instructions for carrying out method 400 and the rest of the methods included herein may be executed by a controller based on instructions stored on a memory of the controller and in conjunction with signals received from sensors of the engine system, such as the sensors described above with reference to FIGS. 1-2. The controller may employ engine actuators of the engine system to adjust engine operation, according to the methods described below.

Referring to FIG. 4, a high-level example method 400 for inferring a rate of vaporization and performing mitigation to prevent increased levels of evaporative emissions is shown. At 402, method 400 includes determining if a sensor indicates a high rate of vaporization. The sensor may be at least one of a FTPT, a HC sensor, or a temperature sensor, as described in FIG. 2. For example, during purging with cool or moderate temperature fuel (e.g., nominal conditions), a vacuum may develop inside the EVAP system from the manifold vacuum, as detected by the FTPT. However, when fuel is hot (e.g., after a car has been driven and/or refueled when ambient temperatures are high), a rate of fuel vaporization may overwhelm a rate of purging (e.g., a rate of desorption). Positive pressure instead of vacuum may build up inside a vapor space of the fuel tank during canister purging. When the FTPT indicates a rate of positive pressure is zero or decreasing, the rate of vaporization may be declining or steady. Indication of positive pressure in the fuel system by the FTPT may indicate the canister is being overloaded and HC vapor may bleed to the engine cylinders and/or the atmosphere, therefore the rate of vaporization may be high.

Additionally or alternatively, a HC sensor may be positioned at a fresh air port of the canister, as described in FIG. 2, and may be used to directly detect HC breakthrough from the canister. In one example, a response of the HC sensor during a drive cycle may indicate HC breakthrough. HC breakthrough may occur when the canister adsorbent is saturated with HC vapor and may not adsorb further concentrations of vaporized HC. The HC sensor response may be interpreted by the controller as indication of a high rate of vaporization above a threshold (e.g., a rate of vaporization greater than a rate of desorption). Further, a temperature sensor imbedded in a carbon bed (e.g., adsorbent) of the canister proximate to the fresh air port may also be used to infer HC breakthrough. In one example, the temperature sensor is a thermocouple positioned at the outlet of the canister, and an increased temperature during a drive cycle may indicate a breakthrough condition. As vapor is adsorbed by the canister, the adsorbent (e.g., activated carbon) may heat up. As HC breakthrough may occur when the adsorbent is overloaded, indication by the temperature sensor of a high temperature that does not decrease may indicate HC breakthrough and therefore a high rate of vaporization.

At 402, if a high vaporization rate is not detected using at least one of the HC sensor, the temperature sensor, or the FTPT, method 400 proceeds to 404 to maintain operating conditions. This may include maintaining the VCE in the fuel efficiency mode (e.g., compression ignition).

At 402, if a high vaporization rate is detected using at least one of the HC sensor, the temperature sensor, or the FTPT, method 400 proceeds to 406 to switch the VCE operating mode from compression ignition (e.g., the fuel efficiency mode) to spark ignition (e.g., the power mode). Further details regarding a switch from compression ignition to spark ignition are described in FIGS. 5A-B. During the power mode, cylinder temperatures may decrease due to spark ignition and a lower compression ratio, compared to the fuel efficiency mode. As a result of lower cylinder temperatures, the rate of vaporization may decrease.

At 408, method 400 includes determining if the rate of vaporization is less than a rate of desorption. The rate of desorption may be a rate at which vapor trapped by absorbent of the canister is desorbed. The rate of desorption may be inferred by the temperature sensor imbedded in the canister such that, when temperature decreases, vapor desorption may occur. In another example, other sensors may be used to directly or indirectly measure a rate of desorption. When the rate of desorption is greater than or equal to the rate of vaporization, HC breakthrough may be mitigated, such that vapor may be desorbed (e.g., purged to the intake manifold of the engine) faster than a rate at which vapor is being produced (e.g., vaporization of liquid fuel). As a result, pre-ignition of fuel due to compression of HC vapors that have bled to engine cylinders may be reduced.

If the rate of desorption is not greater than or equal to the rate of vaporization, method 400 proceeds to 405 to maintain the VCE in the power mode (e.g., using spark ignition and a low compression ratio). The rate of vaporization relative to the rate of desorption may be continuously monitored, as described above.

If the rate of desorption is greater than or equal to the rate of vaporization, at 410, method 400 includes switching the VCE operating mode from spark ignition to compression ignition (e.g., switch from power mode to fuel efficiency mode). Switching from spark ignition to compression ignition may include adjusting the compression ratio from a low compression ratio to a high compression ratio, for example, from 8:1 to 14:1. The compression ratio may be adjusted as described in FIGS. 3A-3B. Switching to compression ignition may further include deactivating a spark plug or ceasing to signal spark plug activation.

Switching from spark ignition to compression ignition, and therefore from the power mode to the fuel efficiency mode, may result in reduced evaporative emissions, reduced pre-ignition of fuel, and reduced engine knock. In this way, method 400 may balance evaporative emissions and fuel economy to reduce or prevent vapor breakthrough to atmosphere. An increase in evaporative emissions may be reduced by activating spark ignition in the VCE during an inferred potential canister breakthrough condition, and a balance between fuel economy and evaporative emissions may be maintained by adjustment of VCE operating modes based on an inferred vaporization rate. The vaporization rate may be constantly monitored by the FTPT, the HC sensor, and the temperature sensor such that, when at least one of the aforementioned sensors indicates a potential high vaporization rate, method 400 may be implemented.

Method 500 of FIGS. 5A-B elaborates on 406 of FIG. 4, where the VCE operating mode is switched from compression ignition to spark ignition (e.g., from fuel efficiency mode to power mode), and shows an example method for adjusting an operating mode of the VCE.

At 502, method 500 includes increasing a CPV duty cycle by a first amount and monitoring engine combustion stability. Increasing the CPV duty cycle may include increasing a percentage of a cycle duration for which the CPV is open. For example, the CPV duty cycle may be increased from 25% to 40%, where the increased duty cycle includes having the CPV open for 40% of a duty cycle duration. Increasing the CPV duty cycle may result in ramping purge flow (e.g., a flow rate through the canister for canister purging is increased), as vacuum of the intake manifold pulls vacuum on the canister to desorb trapped vapor. Engine combustion stability is monitored to determine if engine knock occurs or if there is a change in RPM during canister purging.

At 504, it is determined if RPM dips or flares and if an engine knock sensor registers a response during canister purging. If RPM dips or flares and the engine knock sensor registers a response, at 506, method 500 includes holding the CPV at the present duty cycle. Determining an RPM dip may indicate pre-ignition of fuel due to compression of HC vapor bled to the cylinder during canister purging when the VCE is in compression ignition (e.g., fuel efficiency) mode. Detection of engine knock during canister purging further indicates auto-ignition of HC vapors when the VCE is in fuel efficiency mode, such that a flame front from injected fuel which has been ignited by compression ignition meets with a flame front of auto-ignited HC vapors. Holding the CPV at the present duty cycle may pause canister purging so that a source of engine knock may be determined and mitigating actions may be taken. Method 500 proceeds to 514 to determine a source of engine knock.

Returning to 504, if it is determined that RPM does not dip or flare and/or the engine knock sensor does not register a response during canister purging, at 508, method 500 includes continuing to increase the CPV duty cycle. Purge flow thus continues to be increased. In one example, CPV duty cycle may be increased to a maximum duty cycle, which may include having the CPV open for 90-100% of the duty cycling duration.

While the CPV duty cycle is increased, method 500 includes monitoring the engine combustion stability to determine, at 510, if engine knock occurs. Engine knock may be determined using the engine knock sensor. If, at 510, engine knock is not detected, at 512, method 500 includes returning to nominal purging operation. For example, as knock may not occur during purging, it may be determined that a high vaporization rate (e.g., higher than the rate of desorption such that HC bleeds into the cylinder) may not be sufficiently high to cause engine knock. For example, a quantity of HC vapor bleeding into the cylinder may not be great enough to auto-ignite or auto-ignition of the HC vapor may not result in a flame front large enough to meet the flame front from compression ignited fuel and cause knock. The VCE may continue to operate in the fuel efficiency mode and the rate of vaporization may be monitored by the FTPT, HC sensor, and temperature sensor as described in FIG. 4.

If, at 510, it is determined that engine knock occurs, at 514, method 500 includes determining a source of engine knock. Engine knock may be due to auto-ignition of fuel vapors (e.g., HC vapor) which have bled from the canister to the cylinder. As it has been predicted by at least one of the FTPT, the temperature sensor, or the HC sensor that the rate of vaporization is high, it may be predicted that engine knock is due to auto-ignition of fuel vapors. However, engine knock may be due to auto-ignition of a fuel source other than fuel vapor from the canister. For example, fuel puddles may be present on the walls of the cylinder such that, during compression ignition, the fuel puddles may auto-ignite prior to or after desired ignition of injected fuel. Additionally or alternatively, a temperature of the cylinder may be higher than nominal, for example, during conditions where ambient temperatures are greater than 100° F. and the vehicle has been running for more than an hour or has been sat in the high ambient temperature for two to three days. In this case, pre-ignition of fuel may occur prior to expected ignition (e.g., prior to the piston reaching TDC) due to higher cylinder temperatures during compression ignition, which may degrade the cylinder as torque is generated by pre-ignition that acts in a direction opposite piston movement (e.g., piston movement from BDC to TDC and pre-ignition generating torque pushing the piston from TDC to BDC).

In order to determine the source of engine knock at 514, method 500 includes commanding the CPV off at 516. Commanding the CPV off may result in closing the CPV and thus isolating the canister and the EVAP system from the intake manifold.

If it is determined at 518 that engine knock does not occur when the CPV is commanded off, at 522, method 500 may include proceeding to a further method to determine a cause of engine knock. As engine knock occurs when fuel vapor from the canister is blocked from the cylinder by the closed CPV, there may be a source of fuel or degraded element of the engine system causing engine knock other than HC bleedthrough. In one example, fuel vapor from the canister may cause engine knock when the CPV is commanded closed if the CPV is degraded such that the CPV closes partially or remains open, allowing fuel vapor to enter the canister and pre-ignite or auto-ignite. Additionally or alternatively, engine knock may be caused by a non-ideal fuel being used in the vehicle, for example, a low octane fuel is used to fuel a high-octane combusting engine.

If, at 518, when the canister and fuel system are isolated from the intake manifold and thus engine cylinders, it is determined that engine knock occurs, it may be determined that the source of engine knock is pre-ignition or auto-ignition of vapor from the EVAP system. Method 500 proceeds to FIG. 5B to transition the VCE from the fuel efficiency mode (e.g., compression ignition with a high compression ratio) to the power mode (e.g., spark ignition with a low compression ratio), which may result in reducing HC breakthrough and therefore reducing engine knock.

At 524 of FIG. 5B, method 500 includes duty cycling the CPV at a first percentage. For example, the first percentage may be a nominal duty cycle used during canister purging, such as 25%. Duty cycling the CPV at the nominal duty cycle may result in purge flow being such that an engine stumble (e.g., RPM dip, engine hesitation, or temporary power dip) may be avoided when switching to spark ignition. If the CPV duty cycle is greater than the first percentage, when the compression ratio of the VCE changes from low to high (e.g., 14:1 to 8:1), there may be time lag between a combustion event due to compression ignition and a combustion event due to spark ignition. This may result in an engine stall due to a sudden and increased transfer of vapor from the canister into a cylinder that might not yet be configured to combust the transferred amount of vapor. Therefore, duty cycling the CPV at the first percentage may operate purge flow at a nominal rate, thus reducing potential for engine stall, which may be present when the CPV is operated at a greater percentage, such as earlier in method 500.

At 526, method 500 includes switching from compression ignition to spark ignition. This may include switching the VCE from the fuel efficiency mode to the power mode by first adjusting compression ratios of the VCE. As described in FIGS. 3A-3B, at least one piston of the engine may be adjusted to decrease a compression ratio. Additionally, a signal may be sent from a control system of the vehicle to a spark plug, which may direct the spark plug to spark fuel ignition, as described in FIG. 1. Compression ratio adjustment may occur prior to or in tandem with activation of the spark plug.

At 528, method 500 includes increasing the CPV duty cycle and monitoring engine combustion stability. The CPV duty cycle may be gradually ramped up from the first percentage (e.g., the nominal duty cycle for canister purging) to 100%. For example, gradually ramping up the CPV duty cycle may include increasing the duty cycle percentage by one percent per minute. In another example, ramping up the CPV duty cycle may be faster or slower than the rate of one percent per minute.

Engine combustion stability is monitored to determine if the engine hesitates while the CPV duty cycle is ramping up. For example, the engine may hesitate due to pre-ignition of vapor in the canister, which may indicate that the rate of vaporization is greater than the rate of desorption. Engine combustion stability may be monitored constantly throughout the remainder of method 500.

If, at 530, it is determined that the engine hesitates while the CPV duty cycle is ramping to 100%, at 534, method 500 includes pausing the CPV duty cycle ramp up and maintaining the present CPV duty cycle. Maintaining the CPV duty cycle may allow the engine to combust fuel within the canister without having to compensate for further increase in purge flow. For example, engine hesitation may occur because fuel vapor is entering the canister due to the increasing purge flow and the overwhelming amount of fuel vapor is pre-igniting. Additionally or alternatively, an air fuel ratio within the canister may be improperly enriched (e.g., more fuel than air) or too lean (e.g., more air than fuel) for spark ignition. In another example, the spark plug may misfire or not yet have been activated. If the engine hesitates, the CPV duty cycle is maintained until engine combustion is stable.

If it is determined at 530 that the engine is not hesitating, (e.g., engine combustion is stable), at 532, method 500 includes continuing to increase the CPV duty cycle to 100%. At 536, method 500 includes determining if the CPV duty cycle is equal to 100%. If the CPV duty cycle is not equal to 100%, method 500 returns to 528 to continue gradually increasing the CPV duty cycle to 100% while monitoring engine combustion stability (e.g., to identify engine hesitation).

If, at 536, it is determined that the CPV duty cycle is equal to 100% (e.g., the CPV is open), method 500 returns to 406 of FIG. 4, as the VCE has been switched from compression ignition to spark ignition. The rate of vaporization may have decreased due to the lower compression ratio and spark ignition conditions of the power mode. Referring to FIG. 4, if at 408 it is determined that the rate of vaporization is not less than or equal to the rate of desorption, at 405, method 400 includes maintaining operating conditions. Maintained operating conditions may be conditions described at 536 of method 500, wherein the CPV is duty cycled at 100% (e.g., held open).

During methods 400 and 500 where the rate of vaporization may begin to decrease, for example, as indicated by the FTPT indicating a zero or decreasing rate of positive pressure, the VCE may switch from spark ignition to compression ignition. Indication of a decreasing rate of vaporization may override the methods of FIGS. 4-5B and transition the VCE from the power mode to the fuel efficiency mode to increase fuel economy of the VCE. Transitioning from the power mode to the fuel efficiency mode may be similar to transitioning from the fuel efficiency mode to the power mode. For example, as shown in FIGS. 3A-3B, at least one piston of the engine may be adjusted to increase a compression ratio. Additionally, a signal may be sent from a control system of the vehicle to a spark plug, which may direct the spark plug to halt spark ignition, as described in FIG. 1.

In this way, a high rate of vaporization may be detected by at least one of the FTPT, the HC sensor, or the temperature sensor and an operating mode of the VCE may be switched from the fuel efficiency mode to the power mode. In such a transition, a cylinder compression ratio decreases and spark ignition is implemented. This may result in a decrease in HC breakthrough, a decrease in pre-ignition of fuel, a decrease in fuel auto-ignition, and a decrease in engine knock. Additionally, transitioning the VCE to the power mode may decrease cylinder temperatures due to the low compression ratio. As a result, the rate of vaporization may decrease. The FTPT may indirectly measure the rate of vaporization based on the rate of positive pressure and, when the rate of positive pressure is zero or decreasing, it may be determined that the rate of vaporization is decreasing. When either the rate of vaporization is decreasing or when the rate of vaporization is less than or equal to the rate of desorption, the VCE may transition from the power mode to the fuel efficiency mode. In this way, evaporative emissions may be reduced and engine knock may be mitigated.

FIG. 6 shows an example graph 600 illustrating a high heat drive cycle with a high rate of vaporization. Data displayed on graph 600 was collected during a vehicle drive cycle, such as a drive cycle of the vehicle described in FIGS. 1-2. The vehicle may be configured with a VCE and a controller configured with computer-readable instructions stored on non-transitory memory that, when executed, cause the controller to switch the VCE operation mode between the fuel efficiency mode and the power mode, depending on indication of a high vaporization rate, as described in FIGS. 4-5B. Herein, the graph 600 illustrates conditions that may indicate a high vaporization rate and therefore may result in implementation of method 400 and method 500.

Graph 600 includes a first plot 602 indicating fuel tank pressure, in units of in$H_2O$, where pressure increases from zero up the ordinate (e.g., from 0 to 8 in$H_2O$). Fuel tank pressure may be measured by a FTPT, as described above. Graph 600 also includes a second plot 604 indicating ambient air temperature in units of degrees Fahrenheit. The ordinate for the second plot 604 begins at 100° F. and increases along the ordinate to 102° F. Graph 600 further includes a third plot 606 indicating engine speed in units of RPM, for example, as generated by a controller from a PIP of a Hall Effect Sensor, as shown in FIG. 1. Engine speed increases from zero along the ordinate. Time increases along the abscissa for each of the first plot 602, the second plot 604, and the third plot 606 of the graph 600. Time markers t0-t2 indicate points of interest in the graph 600.

Prior to time t1, the first plot 602 shows fuel tank pressure being equal to approximately zero. Ambient air pressure, as shown by the second plot 604, gradually decreases from greater than 102° F. to approximately 100° F. Engine speed, as shown by the third plot 606, spikes in a first third of a duration between t0 and t1, then gradually decreases as ambient air temperature decreases and is approximately equal to 1100 RPM for the remaining duration between t0 and t1. The duration between t0 and t1 may show conditions during VCE start.

At t1, engine speed dips, as shown by the third plot 606. As described in FIG. 5A, RPM dip may indicate a hesitation in engine combustion, which may be caused by pre-ignition of fuel. For example, torque generated from pre-ignition may push against the piston in a direction of piston motion, where torque pushes the piston from TDC to BDC while piston is moving from BDC to TDC. This may degrade the piston and engine, for example, by applying torque to the crankshaft in a direction opposite crankshaft motion. Fuel tank pressure shown by the first plot 602 increases and, as the rate of positive pressure in the fuel tank increases, the rate of vaporization may increase. In one example, t1 may illustrate conditions when, due to ambient air temperature, the vaporization rate increases, thus increasing fuel tank pressure. Additionally or alternatively, the increase in fuel tank pressure as shown by the first plot 602 may indicate the canister is being overloaded and HC may thus bleed to the engine cylinders and/or the atmosphere. Both the fuel tank pressure and ambient air temperature increase between t1 and t2.

At t2, ambient air temperature as shown by the second plot 604 is high, engine speed dips as shown by the third plot 606, and fuel tank pressure continues to increase, as shown by the first plot 602. In the example of FIG. 6, ambient air temperature is 102.7° F., fuel tank pressure is 7.4in$H_2O$, and RPM dips to approximately zero. The RPM dip at t2 may indicate pre-ignition of fuel, which may be due to HC leak to the cylinder from the overloaded canister. Additionally or alternatively, fuel vaporization may be due to the high ambient temperature, wherein air in the cylinder may be a greater temperature than nominal intake atmospheric air. In this example, the high rate of vaporization may be due to high fuel tank temperature.

Graph 600 of FIG. 6 thus shows one example of fuel tank pressure, ambient air temperature, and engine speed conditions in relation to vaporization rate. The increasing rate of positive fuel tank pressure during canister purging, as measured by the FTPT, may indicate a high rate of vaporization. When high rate of vaporization is indicated, for example, by the FTPT at t2, methods such as those described in FIGS. 4 and 5A-B may be implemented to switch the operational mode of the VCE from the fuel efficiency mode to the power mode, thus switching from compression ignition to spark ignition, decreasing the compression ratio, decreasing cylinder temperature, and thus decreasing the rate of vaporization. In this way, evaporative emissions of HC vapor may be reduced and engine knock due to auto-ignition of HC vapor bled into the cylinder may be reduced. An example of VCE operation conditions during methods 400 and 500 is shown in FIG. 7.

FIG. 7 shows a graph 700 illustrating example VCE operating conditions during a transition from the fuel efficiency mode to the power mode upon detection of a high rate of vaporization. Graph 700 includes plot 702 illustrating an ignition mode of the VCE, with spark ignition and compression ignition shown on the ordinate. Plot 704 shows canister load with canister load increasing up the ordinate. Plot 706 shows compression ratio, where compression ratio increases from low (e.g., 8:1) to high (e.g., 14:1) up the ordinate. Plot 708 shows fuel tank pressure, as measured by the FTPT. Fuel tank pressure in in$H_2O$ increases up the ordinate. Plot 710 shows cylinder temperature, which increases from zero up the ordinate.

Plot 714 shows HC concentration, as measured by the HC sensor. HC concentration increases from zero up the ordinate. Plot 716 shows a position of the CPV as well as a duty cycle of the CPV. An open position and a closed position of the CPV are shown on the ordinate and duty cycle is shown by a frequency at which the CPV changes from the open position to the closed position. Engine knock shown by plot 718 and engine speed shown by plot 720 are shown concurrently, where spikes in plot 718 above nominal engine operating speed, as indicated on the ordinate in RPM, indicate engine knock and dips in plot 720 below nominal engine operating speed indicate engine speed (e.g., RPM) dip. Engine knock may be due to auto-ignition of fuel and/or HC vapors. RPM dip may be due to pre-ignition of injected fuel and/or HC vapor. Plot 722 shows rate of vaporization, as may be inferred by the HC sensor, temperature sensor, or FTPT, as described above. Rate of vaporization increases up the ordinate and threshold 724 indicates a value below which the rate of vaporization is less than or equal to the rate of desorption. Time increases along the abscissa and time markers t0-t1 indicate points of interest, which may correspond to steps of methods 400 and 500, as further described below.

At t0, the VCE may be in a nominal operation mode, where the nominal operation mode is the fuel efficiency mode. The VCE may use compression ignition and thus have a high compression ratio. Canister load is high (e.g., the canister may be overloaded by fuel vapors). Fuel tank pressure is approximately equal to a positive, non-zero value, which indicates the rate of vaporization may be increasing. HC concentration may be a positive, non-zero value, which may indicate breakthrough of HC from the canister, and therefore overloading of the canister. Additionally, the cylinder temperature may be approximately equal to a positive, non-zero value. Outputs of the FTPT, HC sensor, and temperature sensor may therefore indicate the rate of vaporization is greater than the rate of desorption. This may correspond to 402 of FIG. 4, where sensors indicate a high vaporization rate and thus the controller implements method 500 to switch from compression ignition to spark ignition. The CPV duty cycle is increased by a first amount (e.g., as described in 502 of method 500), as shown by a frequency of opening/closing of the CPV increasing in plot 716.

At t1, the VCE remains in the fuel efficiency mode with compression ignition and a high compression ratio. Between t1 and t2, canister load, cylinder temperature, fuel tank pressure, and HC concentration may gradually increase, which may be due to overloading of the canister adsorbent with vaporized HC, and HC vapor not trapped by the canister bleeding out into the EVAP system, as described above. As shown by plot 720, RPM may dip at t1 and, as shown by plot 718, engine knock may occur. As a result, the CPV may be held at the present duty cycle, as described at 506 of method 500. For example, the frequency of opening/closing the CPV may not be increased or decreased.

Engine knock may occur again at t2 and between t2 and t3. To determine a source of engine knock (e.g., to determine if engine knock is due to auto-ignition of HC vapor), the CPV is commanded off (e.g., closed) at t2. HC concentration, cylinder temperature, and fuel tank pressure may stabilize (e.g., may not further increase or decrease) after t2, as the canister adsorbent may be fully saturated with HC vapor and no further HC vapor may be trapped by the canister, such that all vaporized fuel may bleed to the EVAP system. As engine knock continues while the CPV is closed, it may be determined that engine knock is due to auto-ignition of HC vapor bled into the cylinder, and the methods described herein for switching from fuel efficiency mode to power mode to mitigate engine knock may be implemented.

At t3, and as described at 524 of method 500, the CPV may be duty cycled at a first percentage. The CPV duty cycle may be equal to a nominal duty cycle, such as 25%. Duty cycling the CPV at the first percentage instead of maintaining the CPV off or ramping up the CPV duty cycle may help to prevent engine hesitation when switching from the fuel efficiency mode to the power mode. HC concentration, cylinder temperature, fuel tank pressure, and canister load may remain unchanged from prior to t3. Additionally, the rate of vaporization may still be high (e.g., approximately equal to the rate of vaporization prior to t3) and the VCE remains in the fuel efficiency mode.

At t4, the VCE may switch from the fuel efficiency mode to the power mode. Ignition mode may switch from compression ignition to spark ignition (e.g., the spark plug may be commanded on) and the compression ratio may switch from high to low (e.g., 14:1 to 8:1, such as described in FIGS. 3A-3B). Additionally, the CPV duty cycle may gradually increase. This may allow for the rate of vaporization to gradually decrease as cylinder temperature decreases due to spark ignition and a lower compression ratio compared to the fuel efficiency mode.

At t5, when the VCE is operating in the power mode and the CPV duty cycle is increasing, engine hesitation (e.g., RPM dip) may occur, as shown by plot 720. As a result, ramping of the CPV duty cycle is halted and the present CPV duty cycle is maintained (e.g., between t5 and t6). For example, when the CPV duty cycle is increased, increasing concentrations of HC vapor being directed to the cylinder may result in overloading of the canister. By maintaining the present CPV duty cycle, a present concentration of HC vapor may be directed to the cylinder, which may prevent the cylinder from being overloaded (and therefore may prevent engine knock due to auto-ignition and/or RPM dip due to pre-ignition). This may reduce HC bleed as the rate of vaporization decreases during the power mode.

At t6, it may be determined that the rate of vaporization has begun to decrease, as indicated by decrease in cylinder temperature, fuel tank pressure, and canister load. At t6, the CPV duty cycle may be ramped to 100% (e.g., the CPV is fully open). As the CPV duty cycle increases, the rate of vaporization continues to decrease. If, during CPV duty cycle ramping, the engine hesitates as indicated at t5, ramping of the CPV duty cycle may again halt until combustion is stable (e.g., the engine is not hesitating).

At t7, the CPV duty cycle may be 100% and the CPV may be fully open. Additionally, the rate of vaporization may continue to decrease, as indicated by the HC concentration, cylinder temperature, fuel tank pressure, and canister load decreasing. As the canister load decreases, the rate of vaporization may approach being equal to or less than the rate of desorption.

At t8, plot 722 indicating the rate of vaporization may intersect and decrease below threshold 724 indicating the rate of desorption, thus showing the rate of vaporization is equal to or less than the rate of desorption. This indication may result in the CPV duty cycle being switched to nominal operation (e.g., 25%), and the VCE switching from the power mode to the fuel efficiency mode. The compression ratio may switch from 8:1 to 14:1 and the ignition mode may switch from spark ignition to compression ignition. As a result, canister load may be low (e.g., the canister may no longer be overloaded with HC vapor), fuel tank pressure may be less than fuel tank pressure when rate of vaporization is greater than rate of desorption, and cylinder temperature may increase, as the cylinder is under a higher compression ratio compared to during spark ignition. Additionally, HC concentration as measured by the HC sensor may be approximately zero, indicating HC vapor may not bleed out of the canister and is instead trapped by the canister adsorbent.

In this way, upon detection of a high vaporization rate by a FTPT, a method may be implemented to transition from a fuel efficiency mode, including compression ignition and a high compression ratio, to a power mode, including spark ignition and a low compression mode. The high vaporization rate may be additionally or alternatively detected by a HC sensor or a temperature sensor positioned at an outlet of a fuel canister. Transition to the power mode may reduce cylinder temperature and thus reduce the vaporization rate to reduce HC bleed from an overloaded fuel canister to the cylinder. This may reduce pre-ignition of fuel, thus reducing engine hesitation, and may reduce fuel auto-ignition, therefore reducing engine knock. By using the FTPT, HC sensor, and/or temperature sensor to indicate a high rate of vaporization and implement the aforementioned methods, the VCE may experience less engine knock compared to a method that uses detection of engine knock to implement a method for reducing engine knock. Upon detection that the rate of vaporization is less than a rate of vapor desorption from the canister, the VCE may return to nominal operation (e.g., the fuel efficiency mode) to increase fuel economy of the vehicle.

The technical effect of adjusting VCE operating mode to spark ignition and low compression ratio upon detection of a high rate of vaporization is that engine knock and fuel pre-ignition may be reduced and therefore degradation to combustion cylinders and other engine components may be reduced, engine system lifetime may be increased, and fuel economy of the vehicle may be maintained or increased.

FIGS. 1-3B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The disclosure also provides support for a method for a variable compression engine, comprising: adjusting a compression ratio of the variable compression engine in response to hydrocarbon breakthrough above a threshold from a fuel vapor canister of an evaporative emissions control system. In a first example of the method, said adjusting includes reducing the compression ratio. In a second example of the method, optionally including the first example, hydrocarbon breakthrough above the threshold is indicated based on a fuel system pressure sensor. In a third example of the method, optionally including one or both of the first and second examples, hydrocarbon breakthrough above the threshold is indicated based on a fuel system temperature sensor. In a fourth example of the method, optionally including one or more or each of the first through third examples, hydrocarbon breakthrough above the threshold is indicated based on a hydrocarbon sensor coupled in a vent line of the evaporative emissions control system. In a fifth example of the method, optionally including one or more or each of the first through fourth examples, the method further comprises: switching a combustion ignition mode in response to hydrocarbon breakthrough above the threshold from the fuel vapor canister. In a sixth example of the method, optionally including one or more or each of the first through fifth examples, switching the combustion ignition mode includes switching from compression ignition to spark ignition in at least one cylinder of the variable compression engine. In a seventh example of the method, optionally including one or more or each of the first through sixth examples, switching the combustion ignition mode occurs synchronously with reduction in compression ratio on a cylinder by cylinder basis.

The disclosure also provides support for a vehicle system, comprising: a variable compression engine, a spark plug, a fuel system comprising a fuel system temperature sensor, a fuel system pressure sensor, a fuel vapor canister, a canister purge valve, a hydrocarbon sensor coupled in a vent line of an evaporative emissions system, and a controller configured with computer-readable instructions stored on non-transitory memory that, when executed, cause the controller to: adjust an operating mode of the variable compression engine in response to hydrocarbon breakthrough above a threshold from the fuel vapor canister. In a first example of the system, the fuel system temperature sensor is positioned at an outlet of the fuel vapor canister in the vent line of the evaporative emissions system. In a second example of the system, optionally including the first example, hydrocarbon breakthrough is detected by the fuel system temperature sensor indicating a temperature increase above a threshold increase. In a third example of the system, optionally including one or both of the first and second examples, hydrocarbon breakthrough is detected by the hydrocarbon sensor indicating a hydrocarbon concentration above a threshold concentration in the vent line. In a fourth example of the system, optionally including one or more or each of the first through third examples, hydrocarbon breakthrough is detected by the fuel system pressure sensor indicating positive pressure above atmospheric pressure. In a fifth example of the system, optionally including one or more or each of the first through fourth examples, adjusting the operating mode includes adjusting a compression ratio of the variable compression engine via adjusting a piston height. In a sixth example of the system, optionally including one or more or each of the first through fifth examples, adjusting the operating mode further includes adjusting a combustion ignition mode. In a seventh example of the system, optionally including one or more or each of the first through sixth examples, adjusting the combustion ignition mode occurs synchronously with adjustment of the compression ratio on a cylinder by cylinder basis. In an eighth example of the system, optionally including one or more or each of the first through seventh examples, adjusting the operating mode includes decreasing the compression ratio and activating spark ignition. In a ninth example of the system, optionally including one or more or each of the first through eighth examples, adjusting the operating mode further includes increasing a duty cycle of the canister purge valve to 100% while monitoring for engine hesitation using an engine speed sensor. In a tenth example of the system, optionally including one or more or each of the first through ninth examples, increasing the duty cycle includes, upon detection of engine hesitation, holding a present duty cycle and resuming ramping of the duty cycle upon no further detection of engine hesitation. In an eleventh example of the system, optionally including one or more or each of the first through tenth examples, adjusting the operating mode includes increasing the compression ratio and deactivating spark ignition.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a variable compression engine, comprising:

adjusting a compression ratio of the variable compression engine in response to hydrocarbon breakthrough above a threshold from a fuel vapor canister of an evaporative emissions control system; and switching a combustion ignition mode in response to hydrocarbon breakthrough above the threshold from the fuel vapor canister.

2. The method of claim 1, wherein said adjusting includes reducing the compression ratio.

3. The method of claim 2, wherein hydrocarbon breakthrough above the threshold is indicated based on a fuel system pressure sensor.

4. The method of claim 2, wherein hydrocarbon breakthrough above the threshold is indicated based on a fuel system temperature sensor.

5. The method of claim 2, wherein hydrocarbon breakthrough above the threshold is indicated based on a hydrocarbon sensor coupled in a vent line of the evaporative emissions control system.

6. The method of claim 1, wherein switching the combustion ignition mode includes switching from compression ignition to spark ignition in at least one cylinder of the variable compression engine.

7. The method of claim 6, wherein switching the combustion ignition mode occurs synchronously with reduction in compression ratio on a cylinder by cylinder basis.

8. A vehicle system, comprising:

a variable compression engine;

a spark plug;

a fuel system, comprising:

a fuel system temperature sensor;

a fuel system pressure sensor;

a fuel vapor canister;

a canister purge valve;

a hydrocarbon sensor coupled in a vent line of an evaporative emissions system; and a controller configured with computer-readable instructions stored on non-transitory memory that, when executed, cause the controller to:

adjust an ignition mode of the variable compression engine in response to hydrocarbon breakthrough above a threshold from the fuel vapor canister.

9. The vehicle system of claim 8, wherein the fuel system temperature sensor is positioned at an outlet of the fuel vapor canister in the vent line of the evaporative emissions system.

10. The vehicle system of claim 8, wherein hydrocarbon breakthrough is detected by the fuel system temperature sensor indicating a temperature increase above a threshold increase.

11. The vehicle system of claim 8, wherein hydrocarbon breakthrough is detected by the hydrocarbon sensor indicating a hydrocarbon concentration above a threshold concentration in the vent line.

12. The vehicle system of claim 8, wherein hydrocarbon breakthrough is detected by the fuel system pressure sensor indicating positive pressure above atmospheric pressure.

13. The vehicle system of claim 8, further comprising adjusting a compression ratio of the variable compression engine via adjusting a piston height.

14. The vehicle system of claim 13, wherein adjusting the ignition mode occurs synchronously with adjustment of the compression ratio on a cylinder by cylinder basis.

15. The vehicle system of claim 13, wherein adjusting the compression ratio includes decreasing the compression ratio and activating spark ignition.

16. The vehicle system of claim 15, further comprising increasing a duty cycle of the canister purge valve to 100% while monitoring for engine hesitation using an engine speed sensor.

17. The vehicle system of claim 16, wherein increasing the duty cycle includes, upon detection of engine hesitation, holding a present duty cycle and resuming ramping of the duty cycle upon no further detection of engine hesitation.

18. The vehicle system of claim 13, wherein adjusting the compression ratio includes increasing the compression ratio and deactivating spark ignition.

* * * * *